US007392002B2

(12) United States Patent
Nishikawa et al.

(10) Patent No.: US 7,392,002 B2
(45) Date of Patent: Jun. 24, 2008

(54) IMAGE FORMING APPARATUS AND METHOD OF IMAGE FORMING

(75) Inventors: Eiji Nishikawa, Hino (JP); Ryuji Okutomi, Hino (JP); Satoshi Ogata, Hachioji (JP); Tadayuki Ueda, Kokubunji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 306 days.

(21) Appl. No.: 11/234,109

(22) Filed: Sep. 26, 2005

(65) Prior Publication Data

US 2006/0153603 A1 Jul. 13, 2006

(30) Foreign Application Priority Data

Jan. 13, 2005 (JP) ..... 2005-006616

(51) Int. Cl.
*G03G 15/01* (2006.01)

(52) U.S. Cl. ..... 399/301; 399/302

(58) Field of Classification Search ..... 399/38, 399/49, 297, 298, 301, 302, 308; 347/116; 358/1.9, 504, 540
See application file for complete search history.

(56) References Cited

U.S. PATENT DOCUMENTS 6,323,959 B1 * 11/2001 Toyama et al. ..... 382/312
7,203,433 B2 * 4/2007 Kato et al. ..... 399/49
2003/0210412 A1 * 11/2003 Ishibashi ..... 358/1.9

FOREIGN PATENT DOCUMENTS

JP 05-323780 12/1993
JP 2002-023444 1/2002

* cited by examiner

*Primary Examiner*—Hoan H Tran
(74) *Attorney, Agent, or Firm*—Finnegan, Henderson, Farabow, Garrett & Dunner, L.L.P.

(57) ABSTRACT

When conducting a color-shift-correcting mode using a registration mark formed by the image forming section on an image carrier, the image detecting section outputs the image detection signal representing the line width of the registration mark and the control section calculates the line width of the registration mark from the image detection signal. The control section compares a line width of the registration mark with a predetermined reference value of the line width to discriminate between abnormality and normality. If normality, the control section continues the color-shift-correcting mode and if abnormality the control section conducts the image forming system restoration mode after stopping the execution of the color-shift-correcting mode. Therefore, even in the case where a white spot is generated for some reasons on the registration mark, the color-shift-correcting mode can be conducted on the normal registration mark with the help of the image forming system restoration mode.

15 Claims, 10 Drawing Sheets

12A
(i)
θ
CR
SUB-SCANNING DIRECTION
(ii)
FIG. 7 (B) S2
L1
Lth
L2
a
b
c
d
FIG. 7 (C) VTOP
FIG. 7 (D) SP=Dp
t0
ta
tb
tc
td
FIG. 7 (E) D [T1]
T1
FIG. 7 (F) D [T2]
T2
FIG. 7 (G) D [T3]
T3
FIG. 7 (H) D [T4]
T4

IMAGE FORMING APPARATUS AND METHOD OF IMAGE FORMING

BACKGROUND

1. Field of the Invention

The present invention relates to an image forming apparatus which is suitably applied to a color printer and a color copying machine both of a tandem type each having a photoconductor drum and further a color-shift-correcting mode and a color multifunctional machine composed of the aforesaid printer or the copying machine, and to an image forming method.

2. Description of Related Art

A color printer and a color copying machine both of a tandem type and a color multifunctional machine composed of the aforesaid printer or the copying machine have become popular in recent years. In each of these color image forming apparatus, there are provided a laser writing unit, a developing unit, a photoconductor drum, an intermediate transfer belt and a fixing unit, for each of yellow (Y), magenta (M), cyan (C) and black (BK) colors.

For example, the laser writing unit for Y color is arranged so that it draws an electrostatic latent image on the photoconductor drum based on information for color image forming. In the developing unit, toner for Y color is stuck to the electrostatic latent image drawn on the photoconductor drum to form a color toner image. The toner image is transferred onto the intermediate transfer belt from the photoconductor drum. The same process as in the foregoing is carried out for each of M, C and BK colors. The color toner image transferred onto the intermediate transfer belt is further transferred onto a sheet of paper, and then is fixed by the fixing unit.

In the image forming apparatus of this kind, it is essential, for maintaining the optimum quality of color image forming, to correct an image forming section so that color-shift may not be caused among yellow (Y), magenta (M), cyan (C) and black (BK) which reproduce R color, G color and B color of images in a document (hereinafter referred to as color-shift-correcting mode). The color-shift is generally caused by the tolerance for assembling of the writing unit and the photoconductor drum. It is considered that changes in temperatures in the open air or changes of temperatures in an apparatus resulted from the continuous use of the apparatus cause supporting portions for the laser writing unit and the photoconductor drum to be expanded or contracted to generate an aging positional shift thereof resulting in the color-shift.

With respect to the color-shift-correcting mode, a registration mark formed on the intermediate transfer belt or on a paper transfer belt is detected by a detecting means for detecting color-shift (hereinafter referred to a registration mark sensor) such as a reflection type sensor, and each amount of shifting for main scanning, sub-scanning, lateral magnification and skew for other colors is calculated for those of the reference color, whereby, image forming timing is adjusted, to correct the color-shift.

Concerning the color image forming apparatus of this kind, Patent Document 1 discloses an image forming apparatus, a method of controlling the apparatus and a memory medium. This image forming apparatus is provided with a pattern forming means, a pattern detecting means, a pulse width calculating means, a discriminating means and with a calculating means. In the course of calculating an amount of color-shift, the pattern forming means forms a color-shift detecting pattern on an endless-shaped belt through the photoconductor drum.

The pattern detecting means detects the color-shift detecting pattern formed on the endless-shaped belt, and outputs pattern detection signals to the pulse width calculating means. The pulse width calculating means calculates a pulse width by detecting rising time and falling of the pattern detection signals. The discriminating means compares a pulse width outputted from the pulse width calculating means with a pulse width threshold value established in advance, to discriminate the color-shift detecting pattern from a scratch on the belt. The calculating means calculates an amount of shift of each detected color for the reference color, based on the pattern detection data discriminated by the discriminating means from the color-shift detecting pattern.

If the image forming apparatus is constructed as in the foregoing, the color-shift detecting pattern can be discriminated precisely from a scratch on a belt, whereby, an amount of color-shift can be calculated by using only pattern detection data relating to the color-shift detecting pattern.

Further, Patent Document 2 discloses a color image recording method and an apparatus for the same. In this color image recording apparatus, electrostatic latent images for Y, M and C colors are formed on the photoconductor drum in the course of adjusting color balance, then, an electrostatic latent image for each color is developed by a developing unit for each color, and toner images each being of each color of Y, M and C colors are superposed each other on the photoconductor drum, thus, the superposed color toner image is detected by a toner concentration sensor.

A color balancing means inputs a toner concentration detection value obtained by the toner concentration sensor and an image density reference value established in advance to compare them to discriminate between abnormality and normality of image density. For toner of a color discriminated to be abnormal by the color balancing means, electrostatic latent images for the color are formed forcibly on the photoconductor drum, and the electrostatic latent images are developed by the developer for the color so that the toner for the color may be consumed.

If the color image forming apparatus is constructed as in the foregoing, a color image having excellent color balance can be reproduced on an appropriated image density, even in the case where image density is lowered for developing agents of each color, in spite of the toner concentration that is substantially the prescribed value.

(Patent Document 1) TOKKAI 2002-023444 (page 4, FIG. 1)

(Patent Document 2) TOKKAIHEI 05-323780 (page 5, FIG. 1)

A color image forming apparatus in the conventional example has the following problems.

i. When a white spot phenomenon is generated for some reasons on a registration mark, when practicing a color-shift-correcting mode in a color image forming apparatus shown in Patent Document 1 or in a color image recording apparatus shown in Patent Document 2, there is a risk that an amount of color-shift cannot be calculated precisely. The white spot phenomenon in this case is as follows; toner in a trace amount remaining on, and paper dust fine particles sticking unwontedly to, a photoconductor drum in the preceding cycle of charging, exposure, developing and cleaning, are not removed, and these remaining toner and paper dust fine particles prevent normal exposure in the following cycle of charging, exposure, developing and cleaning, resulting in the phenomenon that a part of the registration mark is developed to be white.

If this white spot portion of the registration mark is detected by the registration mark sensor, the mark is detected to be thinner than a width of the reference line in the design of the mark, resulting in a problem that an error is caused in a calculated value of a distance between marks, and in a risk that a precise amount of color-shift cannot be calculated.

ii. If the white spot portion is intermingled in the registration mark, the pattern detection data related to the registration mark having thereon the white spot portion are judged accidentally to be a crack on a belt, in Patent Document 1, and its data are excluded. Thus, the number of data is reduced by an amount corresponding to the excluded data, resulting in lowered reliability such as an average value.

iii. In accordance with Patent Document 2, in the course of adjusting color balance, electrostatic latent images for Y, M and C colors are formed on a photoconductor drum, then, an electrostatic latent image for each color is developed by a developing unit for each color, and toner images each being of each color of Y, M and C colors are superposed each other on the photoconductor drum, and thereby, the image density of the superposed color toner image is detected. Therefore, even when the color balance adjusting technology of this kind is applied on the color-shift correcting mode as it is, it is impossible to calculate a distance between respective colors for Y, M, C and BK. Further, on the color-shift-correcting mode, there is even a risk that toner of each color for respective colors of Y, M, C and BK are used wastefully, because toner for respective colors for Y, M, C and BK are not superposed.

In view of the foregoing, the present invention was attained.

SUMMARY

An object of the invention is to provide an image forming apparatus wherein a color-shift-correcting mode can be carried out in the normal image forming system, even in the case where a white spot is generated for some reasons on a print image, in the course of conducting the color-shift-correcting-mode, and to provide an image forming method.

An aspect of the invention is an image forming apparatus which comprises:

an image carrier to hold a color toner image thereon;

an image forming section to form the color toner image on the image carrier;

a control section which detects an amount of positional shift between a registration mark of the reference color and a registration mark of another color, both registration marks being formed on the image carrier by the image forming section for a color-shift-correction;

a cleaning section to remove the color toner image formed on the image carrier; and an image detecting section which senses the registration mark on the image carrier and outputs an image detection signal representing the line width of the registration mark;

wherein during the execution of the color-shift-correcting mode, where the image forming section forms the registration mark on the image carrier, the control section detects the amount of the position shift of the registration mark and the control section corrects a position of an image according to the amount of the positional shift, the control section calculates the line width of the registration mark from the image detection signal and then compares the line width of the registration mark with a reference value of line width to discriminate between normality and abnormality, then if normality, the control section continues the execution of the color-shift-correcting mode and if abnormality, the control section stops the execution of the color-shift-correcting mode and execute the image forming system restoration mode, where the image forming section forms the color toner image on the image carrier for restoring an image forming system as a restoration image and then the cleaning section removes the restoration image for cleaning the image forming system.

DETAILED DESCRIPTION OF THE PREFFERED EMBODIMENT

Figure 1:
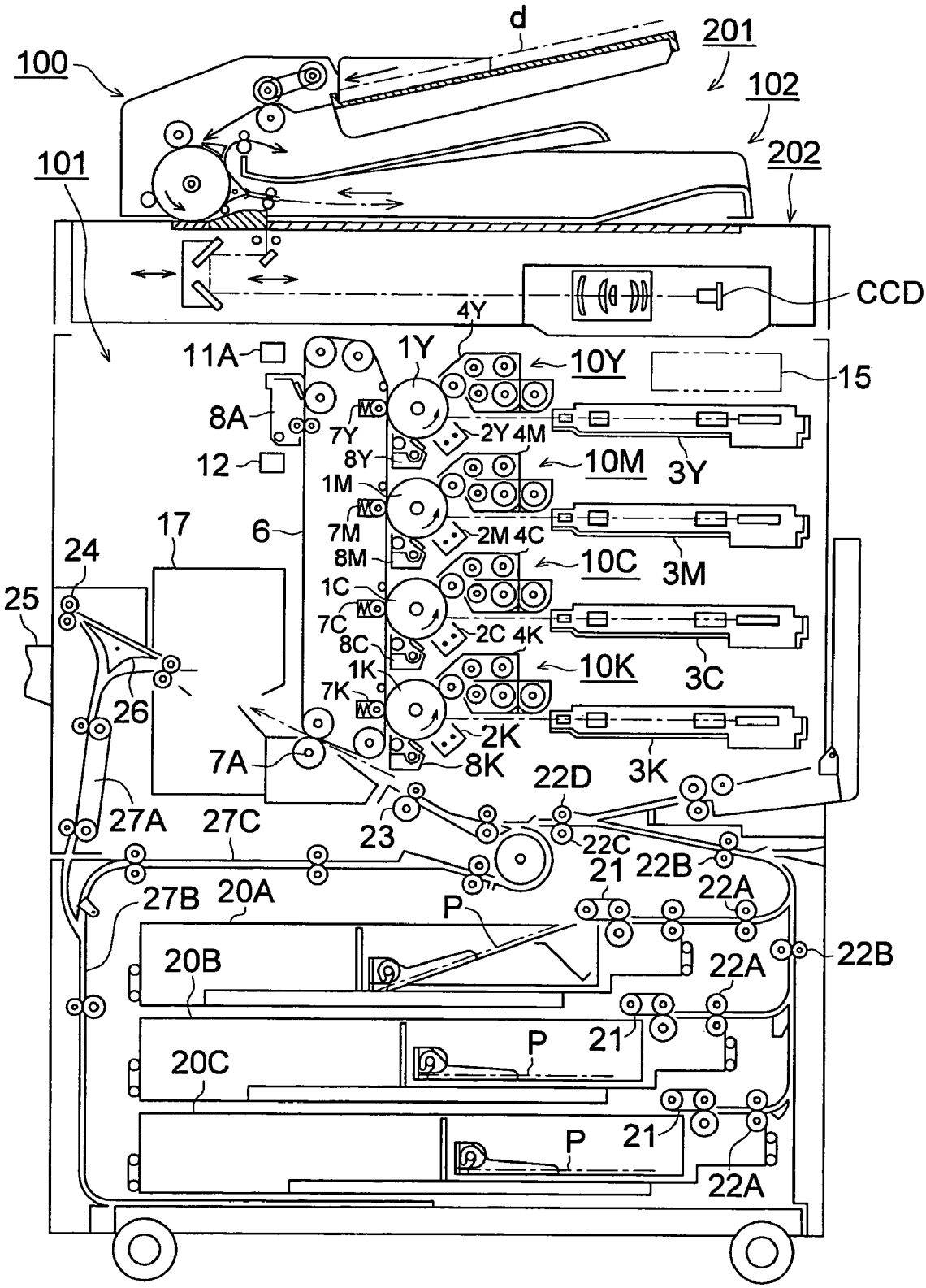
FIG. 1 is a conceptual drawing indicating an example of a structure of color copying machine 100 as an example of present invention.

An aspect of the invention is an image forming apparatus that forms color images on an image carrier wherein, when a color-shift-correcting mode represents an operation to form a print image for correcting color-shift on an image carrier, an operation to read timing of passing of the print image, an operation to calculate an amount of positional shift of the print image for another color for a print image of the reference color and an operation to correct the image forming position based on an amount of the positional shift, while an image forming system restoration mode represents an operation to form an image for adjusting an image forming system on an image carrier and an operation to remove an image for adjusting an image forming system formed on the image carrier, there are provided an image forming section that forms a print image for correcting color-shift on the image carrier, an image detecting section that outputs an image detection signal representing a line width of the print image formed on the image carrier by the image forming section and a control section that calculates a line width from the image detection signal and compares the line width of the print image with a reference value of the line width prepared in advance to discriminate between abnormality and normality, then continues or suspends the color-shift-correcting mode based on the result of the discrimination, and thereby conducts the image forming system restoration mode.

In the image forming apparatus related to the invention, when forming a color image on an image carrier and when conducting a color-shift-correcting mode, the image forming apparatus forms a print image for color-shift-correcting. The image detecting section outputs the image detection signal representing the line width of the print image formed on the image carrier by the image forming section and the control section calculates the line width from the image detection signal. On the assumption of the foregoing, the control section compares a line width of the print image with a reference value of the line width prepared in advance to discriminate between abnormality and normality, then continues or suspends the color-shift-correcting mode based on the result of the discrimination, and thereby conducts the image forming system restoration mode.

Therefore, when discriminated to be "abnormality" in the course of conducting the color-shift-correcting mode, the color-shift-correcting mode is suspended to form on an image carrier an image for adjusting the image forming system, and then, the image formed on the image carrier for adjusting the image forming system is removed, whereby, the image forming section can be restored to the normal situation. Due to this, the color-shift-correcting mode can be conducted on the normal image after being subjected to the image forming system restoration mode, even in the case where a white spot is generated for some reasons on a print image, in the course of conducting the color-shift-correcting-mode.

An image forming method relating to the invention is represented by an image forming method for forming a color image on an image carrier wherein, when a color-shift-correcting mode represents an operation to form a print image for correcting color-shift on an image carrier, an operation to read timing of passing of the print image, an operation to calculate an amount of positional shift of the print image for another color for a print image of the reference color and an operation to correct the image forming position based on an amount of the positional shift, while an image forming system restoration mode represents an operation to form an image for adjusting an image forming system on an image carrier and an operation to remove an image for adjusting an image forming system formed on the image carrier, there are included a process for forming a print image for correcting color-shift on the image carrier, a process for detecting a line width of the print image formed on the image carrier, a process for discriminating between abnormality and normality by comparing a line width of the detected print image with a reference value of the line width prepared in advance and a process for carrying out the image forming system restoration mode by continuing or suspending the color-shift-correcting mode based on the result of the discrimination.

In the image forming method relating to the invention, when discriminated to be "abnormality" in the course of conducting the color-shift-correcting mode in the case of forming a color image on the image carrier, the color-shift-correcting mode is suspended to form on an image carrier an image for adjusting the image forming system, and then, the image formed on the image carrier for adjusting the image forming system is removed, whereby, the image forming section can be restored to the normal situation. Therefore, the color-shift-correcting mode can be conducted on the normal image forming section after being subjected to the image forming system restoration mode, even in the case where a white spot is generated for some reasons on a print image, in the course of conducting the color-shift-correcting-mode.

In the image forming apparatus and the image forming method both relating to the invention, there is provided a control section that conducts a color-shift-correcting mode and an image forming system restoration mode, whereby, a line width of a print image for correcting color-shift is compared with a reference value of a line width prepared in advance to discriminate between abnormality and normality, in the course of conducting the color-shift-correcting mode, thus, the image forming system restoration mode is conducted by continuing or by suspending the color-shift-correcting mode based on the result of the discrimination.

Due to the aforesaid constitution, when discriminated to be "abnormality" in the course of conducting the color-shift-correcting mode in the case of forming a color image on the image carrier, the color-shift-correcting mode is suspended to form on an image carrier an image for adjusting the image forming system, and then, the image formed on the image carrier for adjusting the image forming system is removed, whereby, the image forming section can be restored to the normal situation. Therefore, the color-shift-correcting mode can be conducted on the normal image forming section after being subjected to the image forming system restoration mode, even in the case where a white spot is generated for some reasons on a print image, in the course of conducting the color-shift-correcting-mode.

An image forming apparatus and an image forming method relating to examples of the invention will be explained as follows, referring to the drawings.

FIG. 1 is a conceptual drawing showing an example of the constitution of color copying machine 100 representing an example of the invention.

The color copying machine 100 shown in FIG. 1 is one that constitutes an example of an image forming apparatus, and it is an apparatus for forming a color image by superposing colors on an image carrier based on image information. In this example, the color copying machine 100 is provided with a color-shift-correcting mode and with an image forming system restoration mode. The color-shift-correcting mode, in this case, means operations to form a print image for color-shift correction on an image carrier, then, to read passing timing of the print image, and to calculate an amount of positional shift of a print image for another color from a position of the print image of the reference color, to correct the image forming position based on the amount of the positional shift. The image forming system restoration mode means operations to form an image for adjusting the image forming system on an image carrier and to remove the image for adjusting the image forming system formed on the image carrier.

The color copying machine 100 is composed of copying machine main body 101 and of image reading device 102. On the top of the copying machine main body 101, there is installed image reading device 102 that is composed of automatic document feeder 201 and document image scanning and exposure unit 202. Document d placed on a document table of the automatic document feeder 201 is conveyed by an unillustrated conveyance means, then, images on one side or both sides of the document are subjected to scanning and exposure conducted by an optical system of the document image scanning and exposure unit 202, and incident light that reflects document images is read by line image sensor CCD.

Analog image signals obtained through photoelectric conversion carried out by the line image sensor CCD are subjected to analog processing, A/D conversion, a shading correction and image compression processing in an unillustrated image processing means, to become digital image information. The image information is sent to laser writing units 3Y, 3M, 3C and 3K which constitute an image forming section.

The automatic document feeder 201 mentioned above is provided with an automatic two-sided document conveyance mechanism. This automatic document feeder 201 is made to continuously read contents in multiple sheets of documents d fed from a document placing table, at a single stroke, and to accumulate the contents of the documents in a memory means (electronic RDH function). This electronic RDH function is conveniently used when copying contents in multiple sheets of documents with copying functions, or when transferring multiple sheets of documents d with facsimile functions.

The copying machine main body 101 is one that is called a color image forming apparatus of a tandem type. An image forming section is provided with a plurality of image forming units (hereinafter referred to also as image forming system II) each having an image carrier for each color 10Y, 10M, 10C and 10K, endless-shaped intermediate transfer belt 6 (hereinafter referred to also as image transfer system I), a sheet-feeding conveyance means including a sheet-refeeding mechanism (ADU mechanism) and fixing unit 17 for fixing a toner image.

In this example, the image forming unit 10Y has therein photoconductor drum (image carrier) 1Y, charging unit 2Y, laser writing unit 3Y, developing unit 4Y and cleaning section 8Y for an image forming body, and is made to form an image in yellow (Y) color. For example, the photoconductor drum 1Y is arranged rotatably on the upper portion of the intermediate transfer belt 6 to be close thereto on the right side, and is made to form a toner image in color Y. In this example, the photoconductor drum 1Y is rotated counterclockwise by an unillustrated driving mechanism. On the obliquely lower portion on the right side of the photoconductor drum 1Y, there is provided charging unit 2Y which is made to charge the surface of the photoconductor drum 1Y to a level of the prescribed voltage.

The laser writing unit 3Y is provided just beside the photoconductor drum 1Y substantially, so that the photoconductor drum 1Y charged in advance may be scanned by a laser beam for Y color having prescribed intensity based on image data for Y color. This laser beam is deflected by rotating polygon mirror for Y color for scanning which means so-called writing of Y color image data in the main scanning direction. The main scanning direction is a direction that is in parallel with a rotational axis of the photoconductor drum 1Y which rotates in the sub-scanning direction. The sub-scanning direction is a direction that is perpendicular to the rotational axis of the photoconductor drum 1Y. When the photoconductor drum 1Y rotates in the sub-scanning direction, and the laser beam is deflected in the main scanning direction for scanning, an electrostatic latent image for Y color is formed on the photoconductor drum 1Y.

Developing unit 4Y is provided to be higher than the laser writing unit 3Y, and it operates to develop the electrostatic latent image for Y color formed on the photoconductor drum 1Y. The developing unit 4Y has an unillustrated developing roller for Y color. Toner and carrier for Y color are housed in the developing unit 4Y. Magnets are arranged inside the developing roller for Y color, and the magnets are rotated to convey two-component developing agents obtained by stirring carrier and Y color toner in the developing unit 4Y to the corresponding part on the photoconductor drum 1Y, so that the electrostatic latent image may be developed by Y color toner. This toner image of Y color formed on the photoconductor drum 1Y is transferred onto intermediate transfer belt 6 when primary transfer roller 7Y is operated (primary transfer). On the lower portion of the photoconductor drum 1Y on the left side, there is provided cleaning section 8Y which is made to remove (cleaning) toner remaining on the photoconductor drum 1Y after the preceding writing.

In this example, at a location below image forming unit 10Y, there is provided image forming unit 10M which has therein photoconductor drum 1M, charging unit 2M, laser writing unit 3M, developing unit 4M and cleaning section 8M for an image forming body, and it is made to form an image in magenta (M) color.

For example, the photoconductor drum 1M is arranged rotatably on the lower portion of the aforesaid photoconductor drum 1Y and on the right side of the intermediate transfer belt 6 to be close thereto, to form a toner image in M color. In this example, the photoconductor drum 1M is rotated counterclockwise by an unillustrated driving mechanism. On the obliquely lower portion on the right side of the photoconductor drum 1M, there is provided charging unit 2M which is made to charge the surface of the photoconductor drum 1M to a level of the prescribed voltage.

The laser writing unit 3M is provided just beside the photoconductor drum 1M substantially, so that the photoconductor drum 1M charged in advance may be scanned by a laser beam for M color having prescribed intensity based on image data for M color. This laser beam is deflected by rotating polygon mirror for M color for scanning, thus, writing of M color image data is conducted. When the photoconductor drum 1M rotates in the sub-scanning direction, and the laser beam is deflected in the main scanning direction for scanning, an electrostatic latent image for M color is formed on the photoconductor drum 1M.

Developing unit 4M is provided to be higher than the laser writing unit 3M, and it operates to develop the electrostatic latent image for M color formed on the photoconductor drum 1M. The developing unit 4M has an unillustrated developing roller for M color. Toner and carrier for M color are housed in the developing unit 4M. Magnets are arranged inside the developing roller for M color, and the magnets are rotated to convey two-component developing agents obtained by stirring carrier and M color toner in the developing unit 4M to the corresponding part on the photoconductor drum 1M, so that the electrostatic latent image may be developed by M color toner. This toner image of M color formed on the photoconductor drum 1M is transferred onto intermediate transfer belt 6 when primary transfer roller 7M is operated (primary transfer). On the lower portion of the photoconductor drum 1M on the left side, there is provided cleaning section 8M which is made to remove toner remaining on the photoconductor drum 1M after the preceding writing.

In this example, at a location below image forming unit 10M, there is provided image forming unit 10C which has therein photoconductor drum 1C, charging unit 2C, laser writing unit 3C, developing unit 4C and cleaning section 8C for an image forming body, and it is made to form an image in cyan (C) color.

For example, the photoconductor drum 1C is arranged rotatably on the lower portion of the aforesaid photoconductor drum 1M and on the right side of the intermediate transfer belt 6 to be close thereto, to form a toner image in C color. In this example, the photoconductor drum 1C is rotated counterclockwise by an unillustrated driving mechanism. On the obliquely lower portion on the right side of the photoconductor drum 1C, there is provided charging unit 2C which is made to charge the surface of the photoconductor drum 1C to a level of the prescribed voltage.

The laser writing unit 3C is provided just beside the photoconductor drum 1C substantially, so that the photoconductor drum 1C charged in advance may be scanned by a laser beam for C color having prescribed intensity based on image data for C color. This laser beam is deflected by rotating polygon mirror for C color for scanning, thus, writing of C color image data is conducted. When the photoconductor drum 1C rotates in the sub-scanning direction, and the laser beam is deflected in the main scanning direction for scanning, an electrostatic latent image for C color is formed on the photoconductor drum 1C.

Developing unit 4C is provided to be higher than the laser writing unit 3C, and it operates to develop the electrostatic latent image for C color formed on the photoconductor drum 1C. The developing unit 4C has an unillustrated developing roller for C color. Toner and carrier for C color are housed in the developing unit 4C. Magnets are arranged inside the developing roller for C color, and the magnets are rotated to convey two-component developing agents obtained by stirring carrier and C color toner in the developing unit 4C to the corresponding part on the photoconductor drum 1C, so that the electrostatic latent image may be developed by C color toner. This toner image of C color formed on the photoconductor drum 1C is transferred onto intermediate transfer belt 6 when primary transfer roller 7C is operated (primary transfer). On the lower portion of the photoconductor drum 1C on the left side, there is provided cleaning section 8C which is made to remove toner remaining on the photoconductor drum 1C after the preceding writing.

In this example, at a location below image forming unit 10C, there is provided image forming unit 10K which has therein photoconductor drum 1K, charging unit 2K, laser writing unit 3K, developing unit 4K and cleaning section 8K for an image forming body, and it is made to form an image in black (BK) color.

For example, the photoconductor drum 1K is arranged rotatably on the lower portion of the aforesaid photoconductor drum 1C and on the right side of the intermediate transfer belt 6 to be close thereto, to form a toner image in BK color. In this example, the photoconductor drum 1K is rotated counterclockwise by an unillustrated driving mechanism. On the obliquely lower portion on the right side of the photoconductor drum 1K, there is provided charging unit 2K which is made to charge the surface of the photoconductor drum 1K to a level of the prescribed voltage.

The laser writing unit 3K is provided just beside the photoconductor drum 1K substantially, so that the photoconductor drum 1K charged in advance may be scanned by a laser beam for BK color having prescribed intensity based on image data for BK color. This laser beam is deflected by rotating polygon mirror for BK color for scanning, thus, writing of BK color image data is conducted. When the photoconductor drum 1K rotates in the sub-scanning direction, and the laser beam is deflected in the main scanning direction for scanning, an electrostatic latent image for BK color is formed on the photoconductor drum 1K.

Developing unit 4K is provided to be higher than the laser writing unit 3K, and it operates to develop the electrostatic latent image for BK color formed on the photoconductor drum 1K. The developing unit 4K has an unillustrated developing roller for BK color. Toner and carrier for BK color are housed in the developing unit 4K. Magnets are arranged inside the developing roller for BK color, and the magnets are rotated to convey two-component developing agents obtained by stirring carrier and BK color toner in the developing unit 4K to the corresponding part on the photoconductor drum 1K, so that the electrostatic latent image may be developed by BK color toner. This toner image of BK color formed on the photoconductor drum 1K is transferred onto intermediate transfer belt 6 when primary transfer roller 7K is operated (primary transfer). On the lower portion of the photoconductor drum 1K on the left side, there is provided cleaning section 8K which is made to remove toner remaining on the photoconductor drum 1K after the preceding writing.

An organic photoconductor (Organic Photo Conductor; OPC) is used for each of the aforesaid photoconductor drums 1Y, 1M, 1C and 1K. A scorotron charging electrode is used for each of the charging units 2Y, 2M, 2C and 2K, and DC voltage at several hundreds volts [V] is impressed. On each of the primary transfer rollers 7Y, 7M, 7C and 7K, there is impressed bias voltage for primary transfer whose polarity is opposite to that of toner to be used (positive polarity in the present example).

Intermediate transfer belt 6 is an example of an image carrier on which toner images each being transferred by each of the primary transfer rollers 7Y, 7K, 7C and 7K are superposed so that a color toner image (color image) may be formed. The color image thus formed on the intermediate transfer belt 6 is conveyed to secondary transfer roller 7A when the intermediate transfer belt 6 is rotated clockwise. The secondary transfer roller 7A is located at the lower portion of the intermediate transfer belt 6, and it is caused to transfer the color toner image formed on the intermediate transfer belt 6 onto a sheet of paper transported from an unillustrated sheet feeding means (secondary transfer).

On the left side of the secondary transfer roller 7A, there is provided fixing unit 17 which conducts fixing processing for the sheet of paper on which the color image has been transferred. The fixing unit 17 has therein a fixing roller, a pressure roller and a heater for heating up. In the fixing processing, when the sheet passes through a boundary between the fixing roller that is heated by the heater for heating up and the pressure roller, the sheet is heated and pressed. The sheet after being subjected to fixing is interposed between sheet-ejection rollers 25 to be placed on sheet-ejection tray 25.

In this example, on the upper portion of the intermediate transfer belt 6 on the left side, there is provided cleaning section 8A which operates to remove toner remaining on the intermediate transfer belt 6 after the transfer operation. The cleaning section 8A has a neutralizing portion to neutralize electric charges on the intermediate transfer belt 6 and a pad to remove toner remaining on the intermediate transfer belt 6. The intermediate transfer belt 6 whose belt surface is cleaned by the cleaning section 8A, is then neutralized by the neutralizing portion, to be ready for the succeeding image forming cycle.

On the area that is on the upstream side of the cleaning section 8A and that offers a wide field of vision on the intermediate transfer belt 6, in the copying machine main body 101, there is provided registration sensor 12 representing an example of an image detecting section, which is caused to detect a print image (hereinafter referred to as registration mark CR) for color-shift-correction formed on the intermediate transfer belt 6 by the aforesaid image forming units 10Y, 10M, 10C and 10K, and to generate image detection signals.

Inside the copying machine main body 101, there is provided control section 15 that inputs image detection signals detected by registration sensor 12, then, compares a line width (hereinafter referred to as mark line width) with a reference value of a line width (hereinafter referred to as reference line width) prepared in advance, based on the image detection signals, to discriminate between abnormality and normality, and continues or suspends the color-shift-correcting mode based on the result of the discrimination, and thereby conducts the image forming system restoration mode (forced toner consumption mode). The reference line width, in this case, means a design value of the line width of registration mark CR, and it is stored in non-volatile memory 14 in advance.

In the case of the color-shift-correcting mode, registration mark CR for color-shift-correction is formed on the intermediate transfer belt 6 through photoconductor drums 1Y, 1M, 1C and 1K, then, passing time for the registration mark CR is read to calculate an amount of positional shift of the registration mark CR for another color for the registration mark CR for the reference color, whereby, an image forming position is corrected based on the amount of positional shift. The image forming position means a position where toner images respectively for Y, M, C and K colors are superposed. This image forming position is corrected by adjusting a position to start writing for each of photoconductor drums 1Y, 1M, 1C and 1K.

In the image forming system restoration mode (forced toner consumption mode), a toner image for adjusting image forming system is formed on each of photoconductor drums 1Y, 1M, 1C, 1K and the intermediate transfer belt 6, and a toner image for adjusting image forming system formed on each of photoconductor drums 1Y, 1M, 1C, 1K and the intermediate transfer belt 6 is made to be removed.

Figure 2:
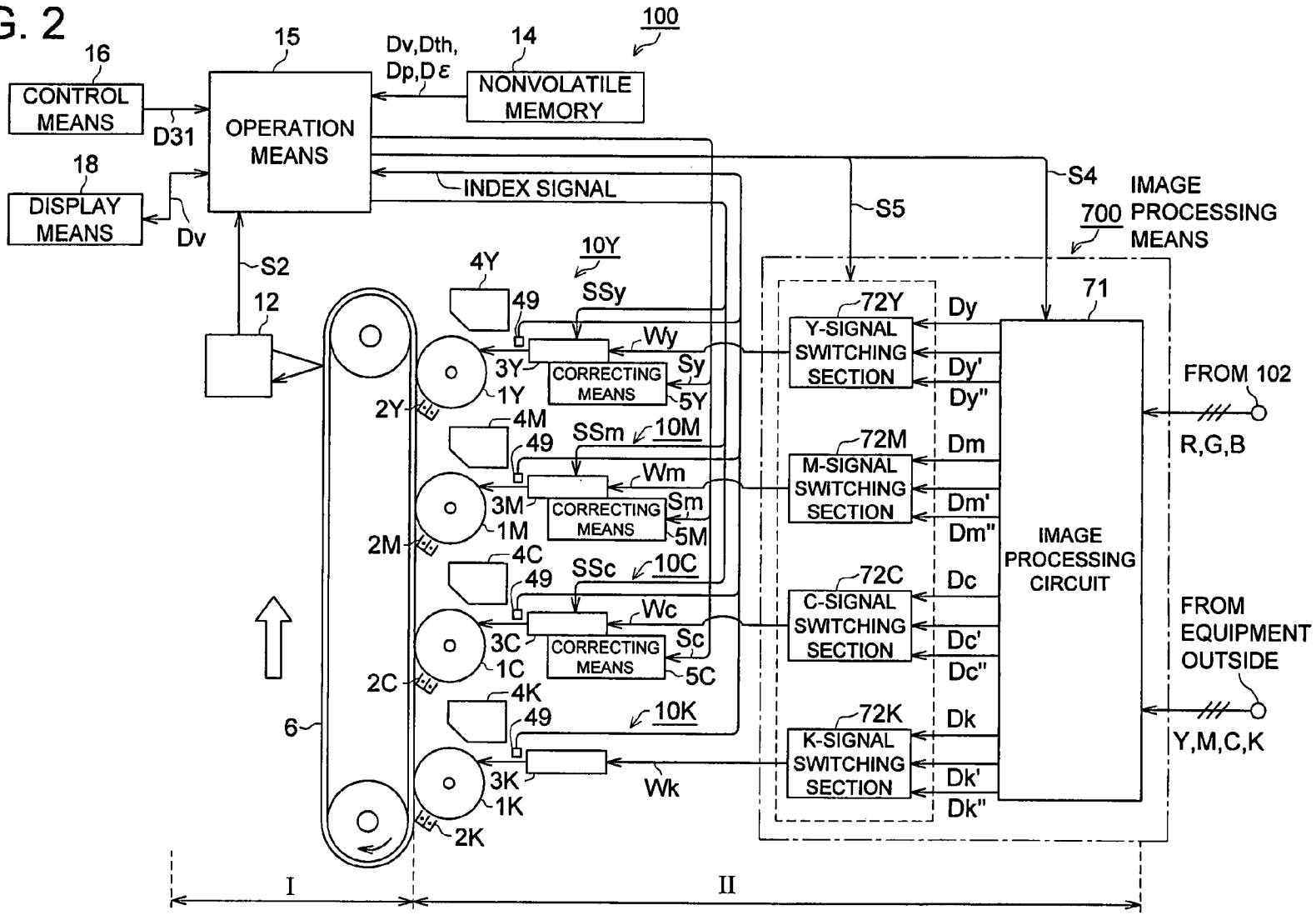
FIG. 2 is a block diagram indicating an example of a structure of image transferring system I and image forming system II in the color copying machine 100.

FIG. 2 is a block diagram showing structural examples of image transfer system I and image forming system II of color copying machine 100. In the color copying machine 100 shown in FIG. 2, processing systems including intermediate transfer belt 6 and registration sensor 12 both shown in FIG. 1 are picked up to be image transfer system I, and image forming units 10Y, 10M, 10C and 10K are picked up to be image forming system II.

In FIG. 2, color copying machine 100 has therein image forming units 10Y, 10M, 10C and 10K, registration sensor 12, non-volatile memory 14, control section 15, operation means 16, display means 18 and image processing means 70.

Registration sensor 12 is connected to control section 15, and when the color-shift-correcting mode is carried out, registration mark CR formed on the intermediate transfer belt 6 is detected and image detection signal S2 is outputted. In the image detection signal S2, there are included components of detection signals for the front edge of the registration mark CR and components of detection signals for the rear edge of the registration mark CR. An optical sensor of a reflection type and an image sensor are used for the registration sensor 12. These sensors are provided with a light-emitting element and a light-receiving element, and light is applied from the light-emitting element to registration mark CR, and its reflected light is detected by the light-receiving element. The control section 15 controls exposure timing for each of laser writing units 3Y, 3M and 3C, based on image detection data Dp after the image detection signals S2 obtained from the registration sensor 12 are subjected to analog/digital conversion.

Operation means 16 is connected to control section 15, and operation data D31 such as image forming conditions are inputted by a user, under the ordinary print mode. Operations are conducted by a user. In addition to the operation means 16, display means 18 is connected to the control section 15, and for example, contents of the color-shift-correcting mode is displayed based on display data Dv. A liquid crystal display is used for the display means 18, and the liquid crystal display is used in combination with an unillustrated touch panel constituting the operation means 16.

Non-volatile memory 14 is further connected to control section 15, and reference line width data Dr related to the reference line width of registration mark CR to be seen when the color-shift-correcting mode is conducted are stored in the non-volatile memory 14. In addition to the reference line width data Dr, color-shift amount threshold value data Dth, image detection data Dp and color-shift-correcting data Dϵ are stored in the non-volatile memory 14. A hard disc and EEPROM are used as the non-volatile memory 14.

The control section 15 controls each of image forming units 10Y, 10M, 10C and 10K so that registration mark CR having a prescribed light width for correcting color-shift may be formed on the intermediate transfer belt 6 through each of photoconductor drums 1Y, 1M, 1C and 1K. Further, the control section 15 controls registration sensor 12 so that a line width of the registration mark CR formed on the intermediate transfer belt 6 may be detected, then, compares a mark line width of the registration mark CR detected by the registration sensor 12 with a reference line width prepared in advance, and continues the color-shift-correcting mode, when a difference between the mark line width and the reference line width is not more than a prescribed value.

When a difference between the mark line width and the reference line width exceeds a prescribed value, the control section 15 suspends the color-shift-correcting mode, and forms a toner image for adjusting image forming system on the intermediate transfer belt 6 through each of photoconductor drums 1Y, 1M, 1C and 1K, to conduct the image forming system restoration mode, and thereafter, the control section 15 conducts the color-shift-correcting mode.

When detecting a mark line width of registration mark CR that is formed on the intermediate transfer belt 6, the control section 15 detects the time of detecting a front edge and the time of detecting a rear edge of registration mark CR formed on the intermediate transfer belt 6 with a reference of the signals to start writing (hereinafter referred to as VTOP signals) allowing the start of writing of registration mark CR on photoconductor drums 1Y, 1M, 1C and 1K, and calculates information about a mark line width (hereinafter referred to mark line width data Dx) concerning the mark line width, based on the time of detecting a front edge and the time of detecting a rear edge of registration mark CR, for the purpose of detecting and discriminating white spots from registration mark CR.

In the image forming system restoration mode, the control section 15 forms toner images respectively for all colors for adjusting the image forming system on the intermediate transfer belt 6 through photoconductor drums 1Y, 1M, 1C and 1K, and controls image forming units 10Y, 10M, 10C and 10K, so that cleaning section 8A may remove all toner images respectively of all colors formed on the intermediate transfer belt 6. Owing to this control, a trace of a lump of toner and foreign substances such as paper dust particles sticking on an unwanted basis, all remaining on the photoconductor drum from the preceding cycle of charging, exposure, developing and cleaning, can be ejected (removed) forcibly, thus, image transfer system I and image forming system II can be restored to the normal state.

Without being limited to the foregoing, the control section 15 may also be arranged, for example, to control the image forming unit 10Y so that an image in Y color only may be formed on the intermediate transfer belt 6 through the photoconductor drum 1Y, and the image in Y color formed on the intermediate transfer belt 6 may be removed by the cleaning section 8A, which was discriminated to be abnormal in the image forming system restoration mode. Even when discriminated to be abnormal in the image forming unit for another color 10M, 10C or 10K, it is also possible to arrange to control each of the image forming units 10Y, 10M, 10C and 10K so that only image in M color, C color or BK color for adjusting the image forming system may be formed on the intermediate transfer belt 6 through each of the photoconductor drums 1M, 1C and 1K, and the image in M color, C color or BK color formed on the intermediate transfer belt 6 through each of the photoconductor drums 1M, 1*c* and 1K may be removed by the cleaning section 8A, in the same way as in the foregoing.

Incidentally, it is also possible to arrange to control the image forming units 10Y, 10M, 10C and 10K so that an image in corresponding color formed on each of the photoconductor drums 1Y, 1M, 1C and 1K in each of the image forming units 10Y, 10M, 10C and 10K may be removed by each of cleaning section 8Y, 8M, 8C and 8K for each color, without transferring primarily a toner image onto the intermediate transfer belt 6, in the image forming system restoration mode.

Image forming units 10Y, 10M, 10C and 10K are connected to the control section 15, and in the image forming unit 10Y, a toner image in Y color is formed on the intermediate transfer belt 6 through photoconductor drum 1Y based on writing data Wy for Y color outputted from image processing means 70. The writing data Wy include image data Dy in an ordinary image forming mode, image data Dy' for forming a registration mark in a color-shift-correcting mode and toner image data Dy" for adjusting the image forming system in the image forming system restoration mode.

Image forming units 10M, a toner image in M color is formed on the intermediate transfer belt 6 through photoconductor drum 1M based on writing data Wm for M color. The writing data Wm include image data Dm in an ordinary image forming mode, image data Dm' for forming a registration mark in a color-shift-correcting mode and toner image data Dm" for adjusting the image forming system in the image forming system restoration mode.

Image forming units 10C, a toner image in C color is formed on the intermediate transfer belt 6 through photoconductor drum 1C based on writing data Wc for C color. The writing data Wc include image data Dc in an ordinary image forming mode, image data Dc' for forming a registration mark in a color-shift-correcting mode and toner image data Dc" for adjusting the image forming system in the image forming system restoration mode.

Image forming units 10K, a toner image in BK color is formed on the intermediate transfer belt 6 through photoconductor drum 1K based on writing data Wk for BK color. The writing data Wk include image data Dk in an ordinary image forming mode, image data Dk' for forming a registration mark in a color-shift-correcting mode and toner image data Dk" for adjusting the image forming system in the image forming system restoration mode.

The image processing means 70 has therein image processing circuit 71, Y-signal switching portion 72M, C-signal switching portion 72C and K-signal switching portion 72K. R, G and B signals relating to R, G and B color components of a color image read from a document, and Y, M, C and K signals relating to an optional print outputted from external equipment such as a printer, are inputted in the image processing circuit 71.

The image processing circuit 71 converts R, G and B signals in terms of a color based on image processing control signals S4, and outputs image data Dy to Y-signal switching portion 72Y. Further, it outputs image data Dy' for correcting color-shift to Y-signal switching portion 72Y based on image processing control signals S4, in the case of the color-shift-correcting mode, and outputs toner image data Dy" for adjusting image forming system in the case of the image forming system restoration mode to Y-signal switching portion 72Y.

In the same way, the image processing circuit 71 converts R, G and B signals in terms of a color based on image processing control signals S4, and outputs image data Dm to M-signal switching portion 72M. Further, it outputs image data Dm' for correcting color-shift to M-signal switching portion 72M based on image processing control signals S4, in the case of the color-shift-correcting mode, and outputs toner image data Dm" for adjusting image forming system in the case of the image forming system restoration mode to M-signal switching portion 72M.

Further, the image processing circuit 71 converts R, G and B signals in terms of a color based on image processing control signals S4, and outputs image data Dc to C-signal switching portion 72C. Further, it outputs image data Dc' for correcting color-shift to C-signal switching portion 72C based on image processing control signals S4, in the case of the color-shift-correcting mode, and outputs toner image data Dc" for adjusting image forming system in the case of the image forming system restoration mode to C-signal switching portion 72C.

In addition, the image processing circuit 71 converts R, G and B signals in terms of a color based on image processing control signals S4, and outputs image data Dk to K-signal switching portion 72K. Further, it outputs image data Dk' for correcting color-shift to K-signal switching portion 72K based on image processing control signals S4, in the case of the color-shift-correcting mode, and outputs toner image data Dk" for adjusting image forming system in the case of the image forming system restoration mode to K-signal switching portion 72C.

The Y-signal switching portion 72Y selects any one of image data Dy, image data Dy' and image data Dy" based on writing selection signal S5, and outputs the image data Dy, image data Dy' or image data Dy" to laser writing unit 3Y. The laser writing unit 3Y is made to detect the irradiation timing of a laser beam for Y color, and to output laser detection signals (hereinafter referred to as Y-INDEX signals).

The M-signal switching portion 72M selects any one of image data DM, image data Dm' and image data Dm" based on writing selection signal S5, and outputs the image data Dm, image data Dm' or image data Dm" to laser writing unit 3M. The laser writing unit 3M is made to detect the irradiation timing of a laser beam for M color, and to output laser detection signals (hereinafter referred to as M-INDEX signals).

The C-signal switching portion 72C selects any one of image data Dc, image data Dc' and image data Dc" based on writing selection signal S5, and outputs the image data Dc, image data Dc' or image data Dc" to laser writing unit 3C. The laser writing unit 3C is made to detect the irradiation timing of a laser beam for C color, and to output laser detection signals (hereinafter referred to as C-INDEX signals).

The K-signal switching portion 72K selects any one of image data Dk, image data Dk' and image data Dk" based on writing selection signal S5, and outputs the image data Dk, image data Dk' or image data Dk" to laser writing unit 3K. The laser writing unit 3K is made to detect the irradiation timing of a laser beam for BK color, and to output laser detection signals (hereinafter referred to as K-INDEX signals). The writing selection signal S5 is outputted from the control section 15 to each of Y-K signals switching portions 72Y-72K.

In the present example, correcting means 5Y is attached on the laser writing unit 3Y for Y color, and an inclination in the horizontal position of the laser writing unit 3Y is adjusted by the correcting means based on unit position correcting signals Sy coming from the control section 15. In the same way, correcting means 5M is attached on the laser writing unit 3M for M color, and an inclination in the horizontal position of the laser writing unit 3M is adjusted by the correcting means based on unit position correcting signals Sm coming from the control section 15. Correcting means 5C is attached on the laser writing unit 3C for C color, and an inclination in the horizontal position of the laser writing unit 3C is adjusted by the correcting means based on unit position correcting signals Sc coming from the control section 15 (partial magnification correcting processing).

For the calculation of an amount of color-shift in the present example, registration mark CR for BK color is used as a reference. A ground for this is to adjust so that positions for writing color images respectively for Y, M and C colors may be aligned with a BK color. For example, with respect to adjustment of a position of writing for Y color, a position of writing of registration mark CR for BK color and a position of writing of registration mark CR for Y color are detected, and an amount of correction is calculated from an amount of shift between the position of writing of registration mark CR for Y color and the position of writing of registration mark CR for BK color. In the same way, with respect to adjustment of writing positions for M and C colors, a position of writing of registration mark CR for BK color and positions of writing of registration marks CR for M and C colors are detected, and each amount of correction is calculated from an amount of shift. After that, positions for image forming for Y, M and C colors are adjusted.

Figure 3:
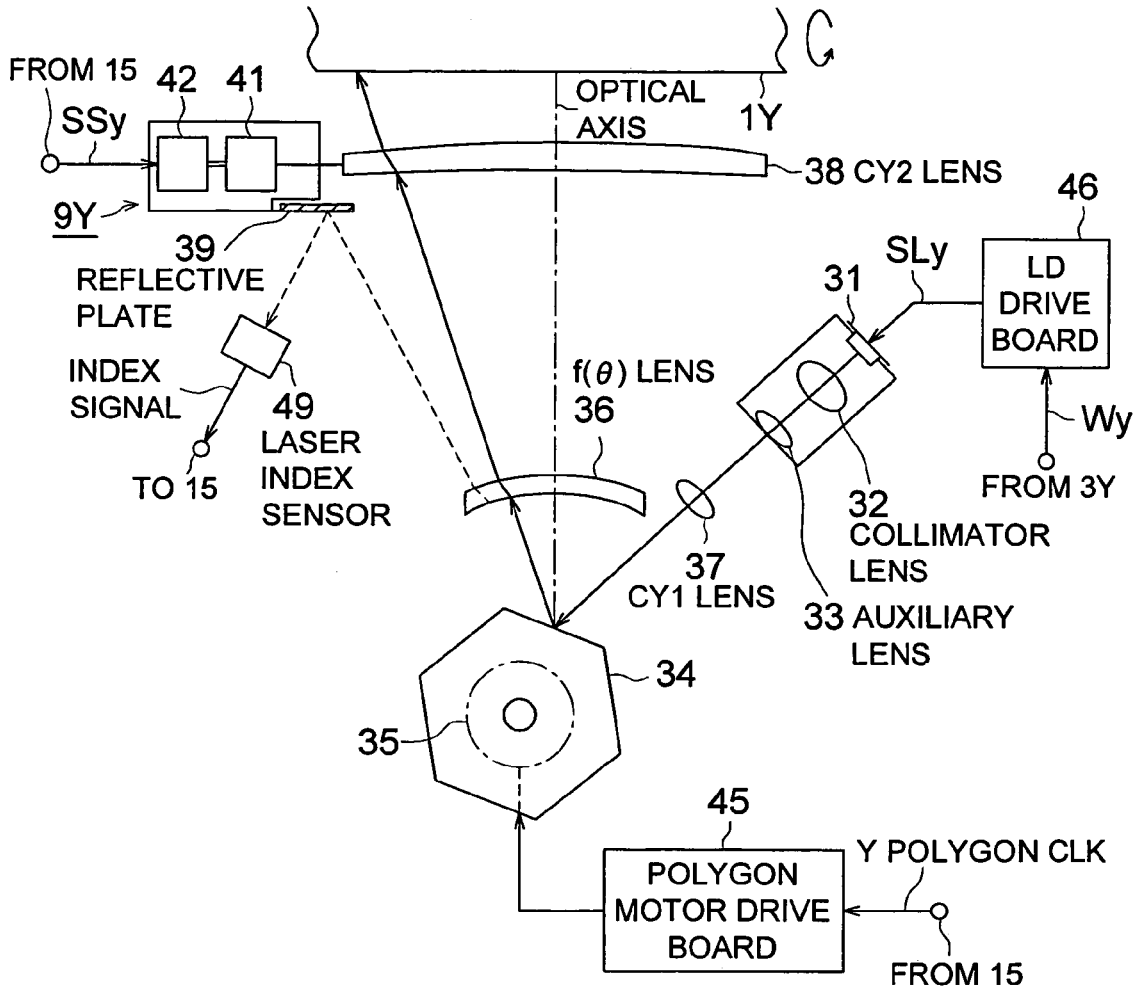
FIG. 3 is a conceptual drawing indicating an example of a structure of laser writing unit 3Y for Y color and skew adjusting device 9Y.

FIG. 3 is a conceptual drawing showing structural examples of laser writing unit 3Y for Y color and its skew adjusting means 9Y. The laser writing unit 3Y for Y color shown in FIG. 3 has therein semiconductor laser light source 31, collimator lens 32, auxiliary lens 33, polygon mirror 34, polygon motor 35, f(θ) lens 36, mirror surface image forming CY1 lens 37, drum surface image forming CY2 lens 38, reflecting plate 39, polygon motor driving base plate 45 and LD driving base plate 46.

The semiconductor laser light source 31 is connected to the LD driving base plate 46 for Y color. Writing data Wy coming from laser writing unit 3Y is supplied to the LD driving base plate 46. On the LD driving base plate 46, the writing data Wy are PWM-modulated, and laser driving signal Sly with a prescribed pulse width after PWM modulation is outputted to the semiconductor laser light source 31. On the semiconductor laser light source 31, a laser beam is generated based on laser driving signal SLy for Y color. The laser beam emitted from the semiconductor laser light source 31 is shaped to a prescribed beam by collimator lens 32, auxiliary lens 33 and CY1 lens 37.

This beam of light is deflected by polygon mirror 34 in the main scanning direction. For example, the polygon mirror 34 is driven by polygon motor 35 to which the polygon motor driving base plate 45 is connected, and Y polygon CLK is supplied to the polygon motor driving base plate 45 from the aforesaid control section 15. The polygon motor driving base plate 45 is made to rotate the polygon motor 35 at a prescribed rotating speed based on Y polygon CLK. The beam of light deflected by the polygon mirror 34 forms an image on photoconductor drum 1Y through f(θ) lens 36 and CY2 lens 38. Owing to these operations, registration mark CR for correcting color-shift is formed on photoconductor drum 1Y, and an electrostatic latent image such as that for a toner image for adjusting an image forming system is formed.

On the laser writing unit 3Y, there is provided skew adjusting means 9Y which is attached on a main body portion. On this main body portion, there is provided reflecting plate 39, and laser index sensor 49 is provided at the position facing the reflecting plate 39. The laser index sensor 49 detects a beam of light deflected by polygon mirror 34, and outputs Y-INDEX signals to the control section 15.

The skew adjusting means 9Y has therein adjustment gear unit 41 and motor for adjustment 42. CY2 lens 38 is attached on the adjustment gear unit 41 in a way that the adjustment gear unit 41 is movable freely on the CY2 lens 38. The motor for adjustment 42 is made to move the adjustment gear unit 41 vertically for adjustment, based on skew adjustment signal SSy. Incidentally, explanation for structural examples of the laser writing units 3M, 3C and 3K for other colors and skew adjusting means for them will be omitted here.

For the calculation of an amount of color-shift in the present example, registration mark CR for BK color is used as a reference. A ground for this is to adjust so that positions for writing color images respectively for Y, M and C colors may be aligned with a BK color. Contents of the correction processing include the following five processing. Among the contents of the correction processing, i-iii processing can be realized by correcting image data, and iv and v are adjusted by driving motor 42 and by driving actually laser writing units 3Y, 3M, 3C and 3K.

i. Main Scanning Correction Processing

This processing is a correction to align positions to start writing in the main scanning direction for color images respectively for Y, M, C and BK colors. For example, with respect to a correction of writing position for Y color, an amount of positional shift in the main scanning direction of Y color for BK color is obtained from image detection data Dp of registration mark CR for BK color and from image detection data Dp of registration mark CR for Y color, and its amount of correction is calculated from the amount of positional shift obtained in this case. Based on the amount of correction, times for writing in the main scanning direction for Y, M and C colors are adjusted, and thereby, writing positions for Y, M and C colors are aligned with that of BK color.

ii. Sub-Scanning Correction Processing

This processing is a correction to align positions to start writing in the sub-scanning direction for color images respectively for Y, M, C and BK colors. For example, with respect to a correction of writing position for Y color, an amount of positional shift in the sub-scanning direction of Y color for BK color is obtained from image detection data Dp of registration mark CR for BK color and from image detection data Dp of registration mark CR for Y color, and its amount of correction is calculated from the amount of positional shift obtained in this case. Based on the amount of correction, times for writing in the sub-scanning direction for Y, M and C colors are adjusted, and thereby, writing positions for Y, M and C colors are aligned with that of BK color.

iii. Total Lateral Magnification Correction Processing

This processing is a correction to align total image forming positions for color images respectively in Y, M, C and BK colors. For example, cycles of image clock signals are adjusted, and thereby, the times for laser emissions are adjusted, and an amount of the total shift in the total lateral magnification is corrected based on the aforesaid adjustments iv. Partial Lateral Magnification Correction Processing This processing is a correction to adjust inclinations in the horizontal positions of various laser writing units 3Y, 3M, 3C and 3K. For example, one end of laser writing unit 3Y in the horizontal direction is fixed on the main body portion, and the other end is made to be movable, and an unillustrated motor is rotated by correction means 5Y for Y color shown in FIG. 2 based on positional correction signals Sy, to drive an adjustment gear unit, so that an inclination of the laser writing unit 3Y in the X-Y (horizontal) direction for photoconductor drum 1Y may be adjusted. This is to adjust an inclination of the laser writing unit 3Y in the horizontal position for photoconductor drum 1Y. The same processing is conducted for other image forming units 10M and 10C.

v. Skew Correction Processing

This processing is a correction to adjust an inclination of a vertical position of CY2 lens 38 in each of laser writing units 3Y, 3M, 3C and 3K. For example, one end of CY2 lens 38 is supported and fixed on the laser writing unit 3Y, and the other end is made to be movable vertically, and motor 42 drives adjustment gear unit 41 in skew adjustment means 9Y for Y color shown in FIG. 3, based on skew adjustment signals SSy, whereby, the CY2 lens 38 is moved vertically to be adjusted. This is to adjust an inclination of the CY2 lens 38 in the vertical position for photoconductor drum 1Y. The same processing is conducted for other image forming units 10M and 10C.

Figure 4:
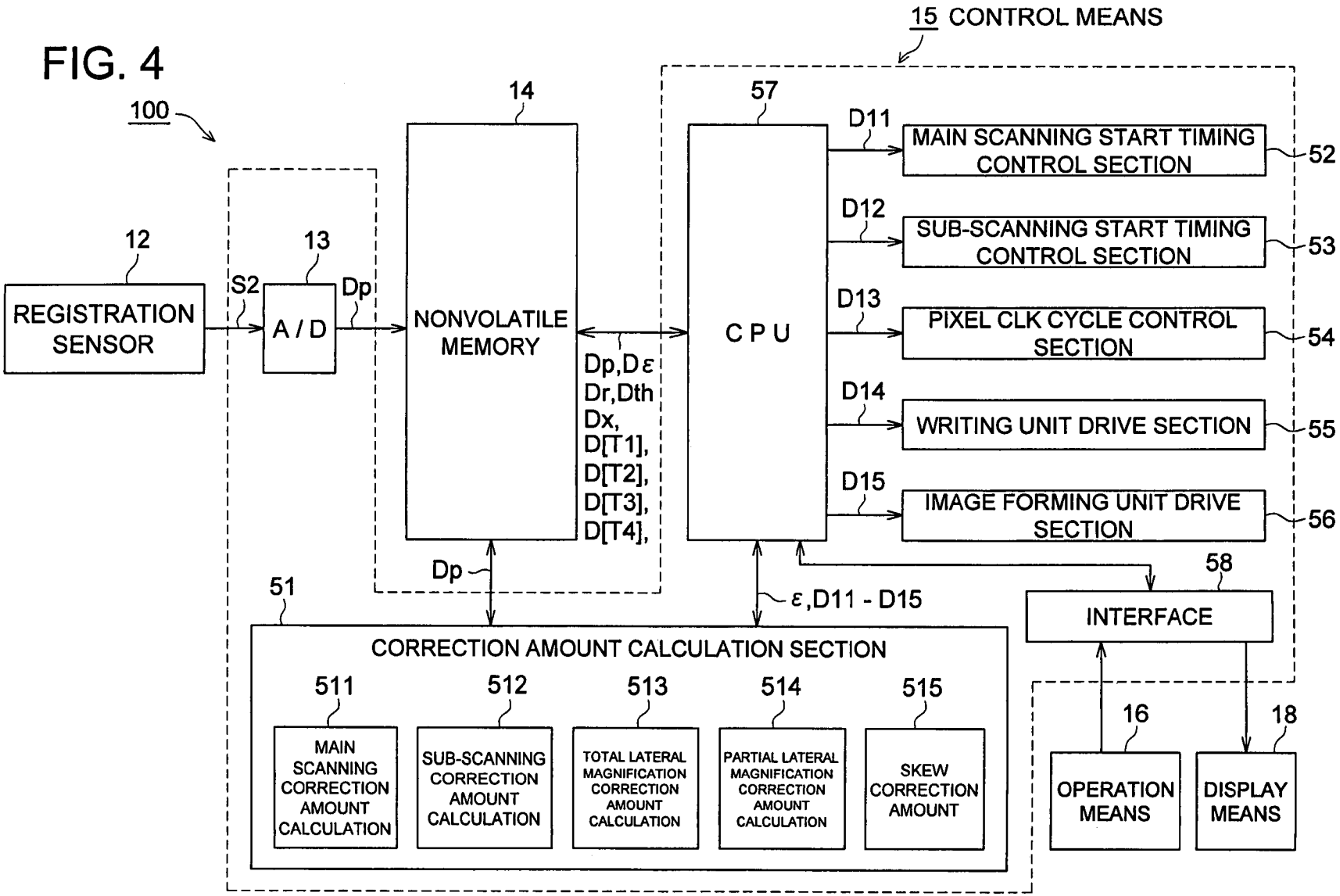
FIG. 4 is a block diagram supplementing the example structure of color copying machine 100.

FIG. 4 is a block diagram to supplement the structural example of a control system of color copying machine 100. The color copying machine 100 shown in FIG. 4 has therein registration sensor 12, non-volatile memory 14, control section 15, operation means 16 and display means 18. The control section 15 is composed of A/D converter 13, correction amount calculating section 51, main scanning start timing control section 52, sub-scanning start timing control section 53, pixel clock cycle control section 54, writing unit driving section 55 and CPU 57.

The registration sensor 12 is connected to the A/D converter 13. In the A/D converter 13, image detection signal S2 outputted from the registration sensor 12 is subjected to A/D conversion in the case of color-shift-correcting mode, and image detection data Dp after binarization are outputted. The A/D converter 13 is connected to the non-volatile memory 14. In the non-volatile memory 14, there are stored mark line width data Dx and elapsed time information D [T1], D [T2], D [T3] and D [T4], in addition to reference line width data Dr, color-shift amount threshold value data Dth, image detection data Dp and color-shift correction data Dϵ.

The non-volatile memory 14 is connected to the correction amount calculating section 51 and to CPU 57. The correction amount calculating section 51 is composed of main scanning correction amount calculating section 511, sub-scanning correction amount calculating section 512, total lateral magnification correction amount calculating section 513, partial lateral magnification correction amount calculating section 514 and skew correction amount calculating section 515. In the correction amount calculating section 51, image detection data Dp are read from the non-volatile memory 14 in the case of color-shift-correcting mode, and an amount of shift for each error factor (main scanning, total magnification, partial lateral magnification and skew) is calculated from this image detection data Dp, thus, an amount of correction for each error factor is obtained from the amount of shift thus calculated.

For example, in the main scanning correction amount calculating section 511, image detection data Dp are read from the non-volatile memory 14 to calculate an amount of shift in the main scanning direction, and timing control data D11 to adjust the timing to start writing in the main scanning direction so that the amount of shift may be eliminated, are outputted. Owing to this timing control data D11, a positional shift in the main scanning direction is corrected.

In the sub-scanning correction amount calculating section 512, image detection data Dp are read from the non-volatile memory 14 to calculate an amount of shift in the sub-scanning direction, and timing control data D12 to adjust the timing to start writing in the sub-scanning direction so that the amount of shift may be eliminated, are outputted. Owing to this timing control data D12, a positional shift in the sub-scanning direction is corrected.

In the sub-scanning correction amount calculating section 513, image detection data Dp are read from the non-volatile memory 14 to calculate an amount of shift in the total lateral magnification, and clock control data D13 to adjust frequency of pixel clock signals so that the amount of shift in the total lateral magnification may become eliminated, are outputted. Owing to this clock control data D13, a positional shift in the total lateral magnification is corrected.

In the partial lateral magnification correction amount calculating section 514, image detection data Dp are read from the non-volatile memory 14 to calculate an amount of shift in the partial lateral magnification, and unit control data D14 to adjust an inclination of laser writing unit 3Y in the horizontal direction so that an amount of shift in the partial lateral magnification may be eliminated, are outputted. Owing to this unit control data D14, an amount of shift in the partial lateral magnification is corrected.

In the skew correction amount calculating section 515, image detection data Dp are read from the non-volatile memory 14 to calculate an amount of shift in skew, and skew control data D15 to adjust an inclination of laser writing unit 3Y in the vertical direction so that an amount of shift in the skew may be eliminated, are outputted. Owing to this skew control data D15, an amount of shift in the skew is corrected.

CPU 57 adjusts the timing to start writing for each of Y color, M color and C color, CLK frequency and inclinations in the horizontal direction and the vertical direction, in accordance with an amount of correction for each error factor. For example, CPU 57 outputs timing control data D11 prepared by main scanning correction amount calculating section 511 to main scanning start timing control section 52. The main scanning start timing control section 52 operates, based on timing control data D11, to adjust the timing to start writing in the main scanning direction so that an amount of positional shift in the main scanning direction may be eliminated. Further, CPU 57 outputs timing control data D12 prepared by sub-scanning correction amount calculating section 512 to sub-scanning start timing control section 53. The sub-scanning start timing control section 53 operates, based on timing control data D12, to adjust the timing to start writing in the sub-scanning direction so that an amount of positional shift in the sub-scanning direction may be eliminated.

Further, CPU 57 outputs clock control data D13 prepared by total lateral magnification correction amount calculating section 513 to pixel clock cycle control section 54. In pixel clock cycle control section 54, an amount of shift of the total lateral magnification is corrected based on the clock control data D13. CPU 57 outputs unit control data D14 prepared by partial lateral magnification correction amount calculating section 514 to writing unit driving section 55. In the writing unit driving section 55, an amount of shift for the partial lateral magnification is corrected based on unit control data. Further, CPU 57 outputs skew control data D15 prepared by the skew correction amount calculating section 515 to image forming unit driving section 56. In the image forming unit driving section 56, an amount of shift for skew is corrected based on skew control data D15.

Figure 5:
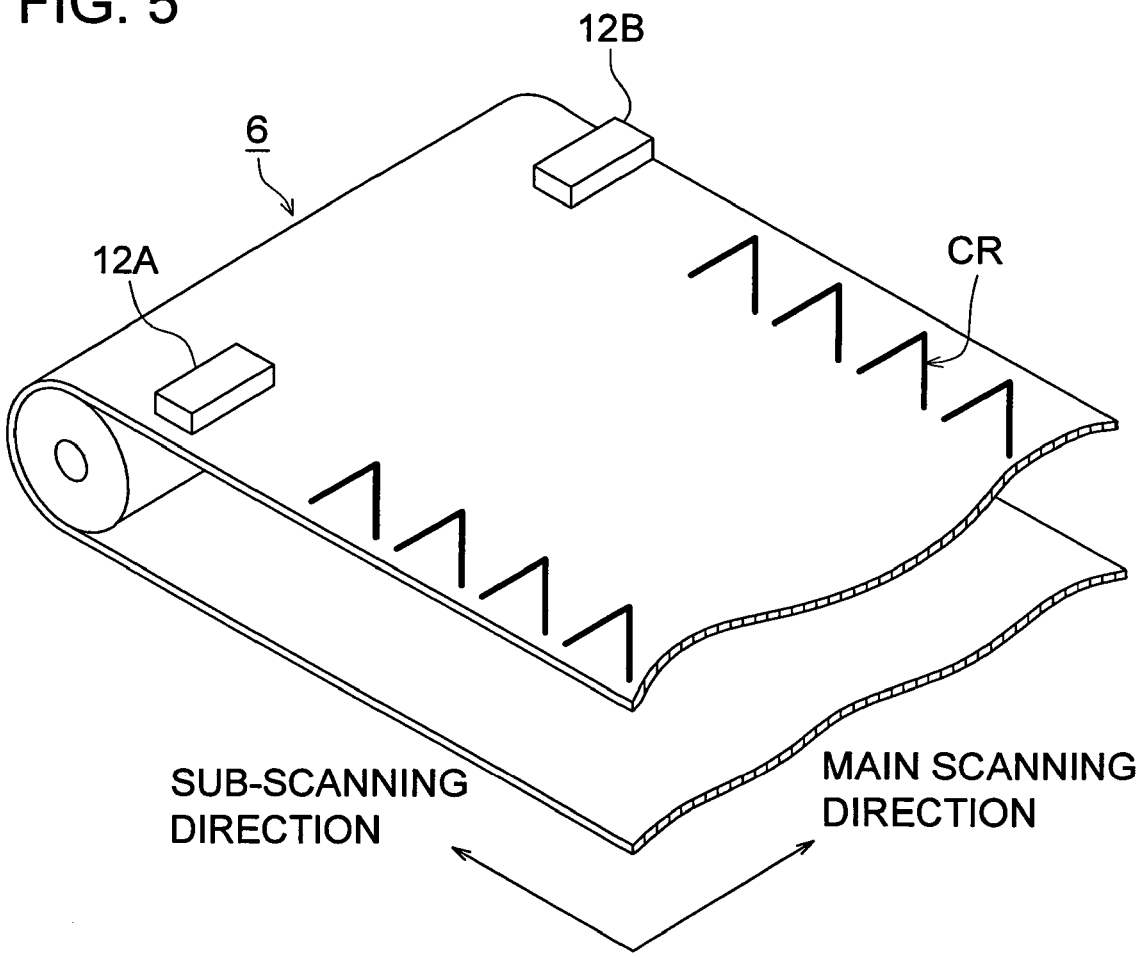
FIG. 5 is a perspective drawing showing examples of detecting registration mark CR by two registration sensors 12A and 12B.

FIG. 5 is a perspective view showing an example wherein registration marks CR are detected respectively by two registration sensors 12A and 12B. Each of the registration sensors 12A and 12B shown in FIG. 5 is an area from which the entire surface of the intermediate transfer belt can be looked around, and that area is provided on each of both ends of intermediate transfer belt 6, and detects registration mark CR formed on each of both sides of the intermediate transfer belt 6 by each of image forming units 10Y, 19M, 10C and 10K, during the course of color-shift-correcting mode.

Figure 6:
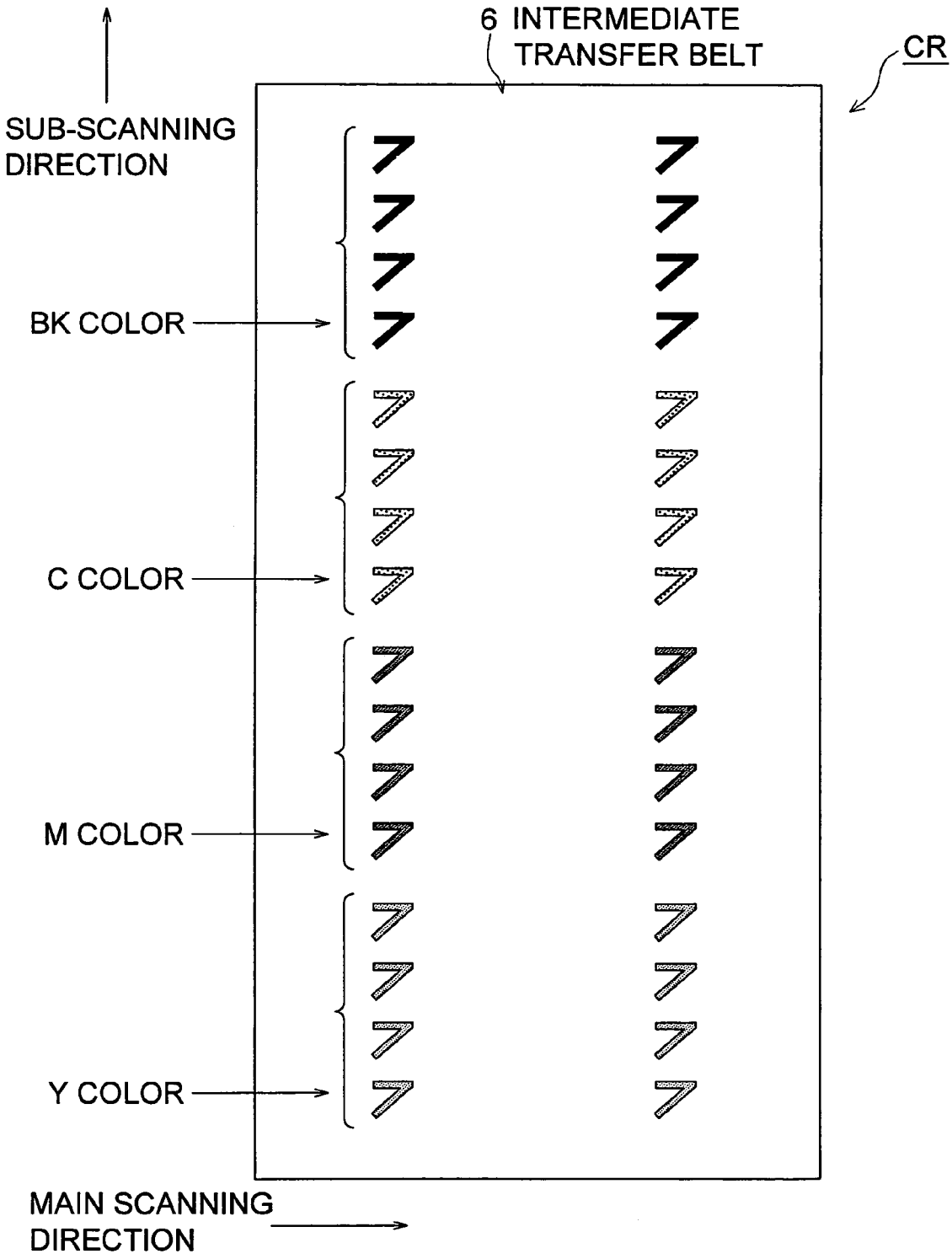
FIG. 6 is a drawing showing an example of forming registration mark CR for color-shift correction

FIG. 6 is a diagram showing an example of forming registration mark CR for correcting color-shift. Registration mark CR shown in FIG. 6 is one formed in the course of the color-shift-correcting mode. When the direction of the width of the intermediate transfer belt 6 is made to be the main scanning direction, in this example, the registration mark CR is composed of a line segment that is in parallel with the main scanning direction and a line segment having a prescribed angle (for example, 45°) for the main scanning direction. For example, the registration mark CR is in a laid-V-shaped form. Image forming units 10Y, 19M, 10C and 10K are controlled by CPU 57 shown in FIG. 4 so that registration mark CR may be formed on intermediate transfer belt 6.

In the present example, in the sub-scanning direction representing the direction for the intermediate transfer belt 6 to move, BK color registration marks CR in a laid-V-shaped form for color-shift correction are continuously formed on left and right sides in quantity of four each, then, this is followed by continuous forming of four each of registration marks CR in C color on left and right sides, and further, four registration marks CR in M color are continuously formed on each of left and right sides, and then, four registration marks CR in Y color are continuously formed on each of left and right sides. A ground of forming four registration marks CR in each color on each of left and right sides is to detect image forming positions for registration marks CR in respective colors, and to correct the image forming positions accurately.

These registration marks CR for color-shift correction are detected by registration sensors 12A and 12B, then, and an amount of color-shift for an image forming position of registration mark CR in each color is calculated, and positions of image forming for Y, M and C colors are corrected. This correction is for the purpose of superposing accurately color images based on optional image data Dy, Dm, Dc and Dk, in the image forming system after conducting color-shift-correcting mode.

FIG. 7(A)-7(H) are diagrams showing an example of binarization of image detection signals S2 by registration sensor 12A or the like.

Figure 7:
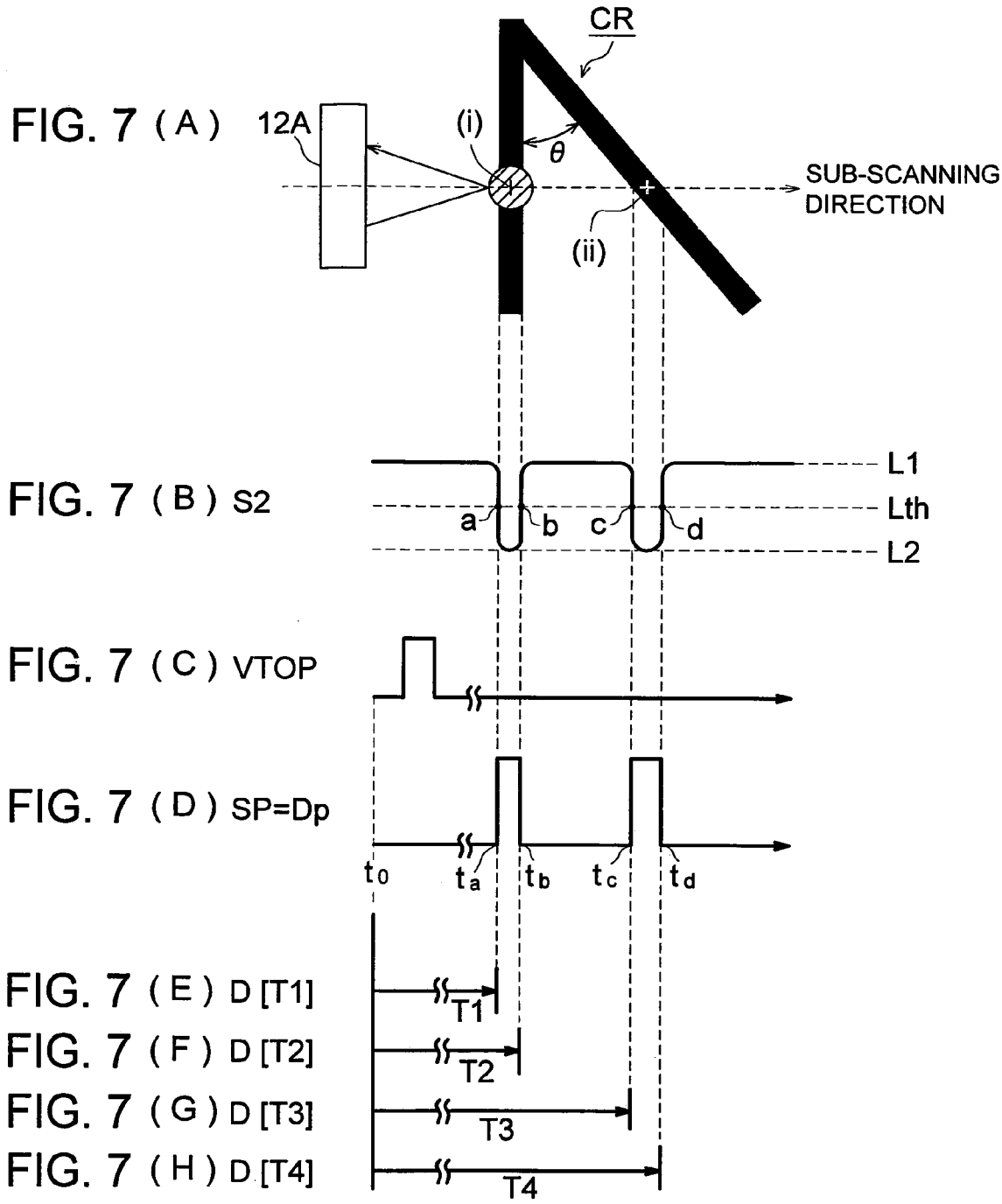
FIG. 7(A) to (H) are the drawings indicating examples of binarization of image detection signal S2 by registration sensor 12A and so forth.

The registration sensor 12A shown in FIG. 7(A) detects an edge of straight line portion (i) and an edge of inclined portion (ii) of registration mark CR on intermediate transfer belt 6 in the diagram, and outputs image detection signal S2. In this example, angle θ formed by registration mark CR in a laid-V-shaped form is 45°. The intermediate transfer belt 6 travels in the sub-scanning direction at a constant linear speed. In the registration sensor 12A, light is applied on registration mark CR from an unillustrated light-emitting element, and its reflected light is detected by a light-receiving element.

Image detection signal S2 shown in FIG. 7(B) is obtained from registration sensor 12A, and in this image detection signal S2, L1 represents a level for belt (surface) detection. Lth represents a threshold value for binarize the image detection signal S2, and L2 is a mark detection level relating to registration mark CR. Point a is a point where a front end edge of straight line portion (i) of the registration mark is detected by registration sensor 12A, and its image detection signal S2 crosses the threshold value Lth, and it gives front end edge detection time ta. The first passing time pulse signal Sp shown in FIG. 7(D) rises at this front end edge detection time ta.

Point b is a point where a rear end edge of straight line portion (i) of the registration mark is detected in the same way, and its image detection signal S2 crosses the threshold value Lth, and it gives rear end edge detection time tb. The passing time pulse signal Sp shown in FIG. 7(D) falls at this rear end edge detection time tb.

In the same way, point c is a point where a front end edge of inclined portion (ii) of the registration mark is detected by registration sensor 12A, and its image detection signal S2 crosses the threshold value Lth, and it gives front end edge detection time tc. The second passing time pulse signal Sp shown in FIG. 7(D) rises at this front end edge detection time tc.

Point d is a point where a rear end edge of inclined portion (ii) of the registration mark is detected in the same way, and its image detection signal S2 crosses the threshold value Lth, and it gives rear end edge detection time td. The passing time pulse signal Sp shown in FIG. 7(D) falls at this rear end edge detection time td. Passing time pulse signal Sp after binarization becomes image detection data Dp. The image detection data Dp is used for calculating an amount of shift of writing position for each of Y, M and C colors.

A mark line width in the sub-scanning direction of straight line portion (i) of the registration mark is obtained based on elapsed time T2 shown in FIG. 7(F) and elapsed time T1 shown in FIG. 7(E), when the intermediate transfer belt 6 travels in the sub-scanning direction at a constant linear speed. When start writing signal (VTOP signal) rises at time t0 shown in FIG. 7(F), then, an unillustrated counter is started, and when the number of pulses of the reference clock signal is counted afterwards, and front end edge detection time ta comes, the elapsed time T1 is obtained by the output value (elapsed time information D [T1]) outputted from the aforesaid counter.

The VTOP signals are those (image forefront signals) each allowing writing of registration mark CR on each of photoconductor drums 1Y, 1M, 1C and 1K. In the same way, when the counter further counts the number of pulses of the reference clock signal, and when the rear end edge detection time tb comes, the elapsed time T2 is obtained by the output value (elapsed time information D [T2]) outputted from the aforesaid counter. These elapsed time information D [T1] and D [T2] are stored in non-volatile memory 14. When calculating a width of a line, the elapsed time information D [T1] and D [T2] are read from the non-volatile memory 14. In the control section 15, a mark line width in the sub-scanning direction of registration mark straight line portion (i) is calculated by (T1−T2) based on elapsed time information D [T1] and D [T2].

Further, a mark line width in the sub-scanning direction of registration mark inclined portion (ii) is given, in the same way, based on elapsed time T4 shown in FIG. 7(H) and elapsed time T3 shown in FIG. 7(G). When VTOP signal rises at time t0 shown in FIG. 7(C), then, a counter is started, and when the number of pulses of the reference clock signal is counted afterwards, and front end edge detection time tc comes, the elapsed time T3 is obtained by the output value (elapsed time information D [T3]) outputted from the aforesaid counter.

In the same way, when the counter further counts the number of pulses of the reference clock signals, and when rear end edge detection time tb comes, elapsed time T4 is obtained by output value (elapsed time information D [T4]) outputted from the counter. These elapsed time information D [T3] and D [T4] are stored in non-volatile memory 14. When calculating a width of a line, the elapsed time information D [T3] and D [T4] are read from the non-volatile memory 14. In the control section 15, a mark line width in the sub-scanning direction of registration mark inclined portion (ii) is calculated by $\sqrt{2}\cdot(T4-T3)/2$ based on elapsed time information D [T3] and D [T4]. Information obtained after these calculations results in mark line width data Dx. Incidentally, even for the registration sensor 12B, functions are the same as the foregoing, thereby, an explanation for them will be omitted.

Figure 8:
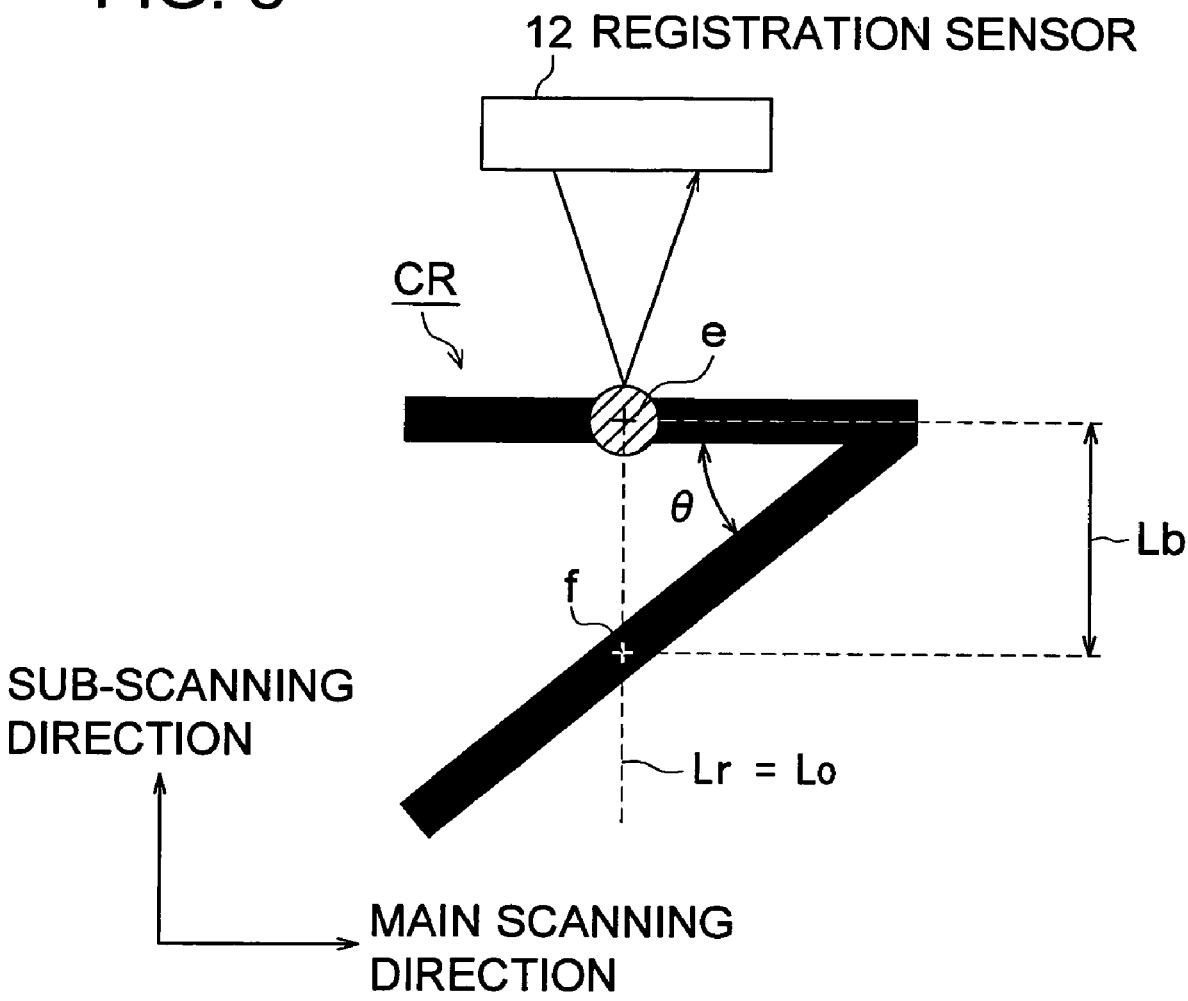
FIG. 8 is a drawing indicating the relationship between registration mark CR for color-shift correction and registration sensor 12.

FIG. 8 is a diagram showing an example of relationship between registration mark CR for color-shift correction and registration sensor 12.

The registration mark CR shown in FIG. 8 is composed of a line segment that is in parallel with the main scanning direction and of a line segment that forms an angle of θ=45° with the main scanning direction. In the present example, an auxiliary line that is in parallel with the sub-scanning direction is drawn from point e that is a center of the line segment being parallel with the main scanning direction, and when f represents a point where the line segment having an angle of 45° intersects this auxiliary line, a length of a line segment between point e and point f is represented by Lb. In this example, positional relationship in the main scanning direction for the point of detection of registration sensor 12 of registration mark CR for color-shift correction can be detected by calculating the length Lb of the line segment between point e and point f, from a difference between detection times for point e and point f of the registration mark CR.

Figure 9:
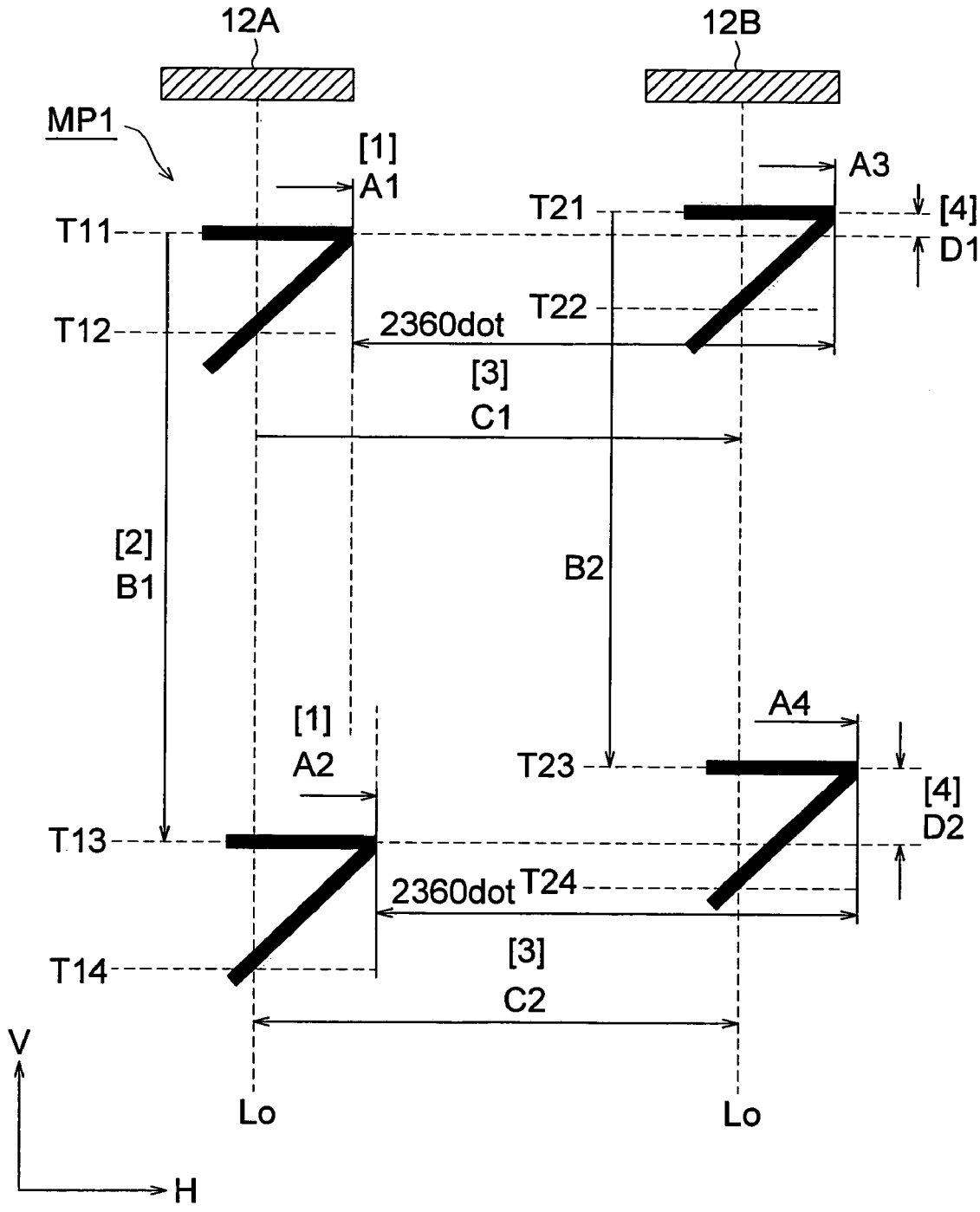
FIG. 9 is a drawing indicating an example of calculation of amount of color-shift correction in the course of color-shift correcting mode.

FIG. 9 is a diagram showing an example of calculation of an amount of color-shift correction in the case of the color-shift-correcting mode. With respect to an amount of color-shift correction in this example, it is calculated with a reference of the registration mark CR for BK color, because each writing position for registration marks CR respectively for Y, M and C colors is adjusted to be aligned with that of the registration mark CR for BK color. For example, with respect to adjustment for writing position for C color, a writing position of the registration mark CR for BK color and a writing position of the registration mark CR for C color are detected, and an amount of shift between writing positions for BK color and C color is calculated, to obtain an amount of correction.

In this case, when T11 represents the time when the registration sensor 12A shown in FIG. 9 detects the straight line portion (i) in the main scanning direction for BK color at the left end, when T12 represents the time when the same registration sensor 12A detects the inclined portion (ii) of the same registration mark CR, when A1 represents a jumping-out distance covering from detection trace line Lo of the same sensor 12A to one end of the registration mark CR for C color at the left end, and when A2 represents a jumping-out distance covering from detection trace line Lo of the same sensor 12A to one end of the registration mark CR for C color on the left side in the main scanning direction for BK color at the left end, a value of rough adjustment in the main scanning direction [1] is calculated by expression (1), namely, by the following expression.

$$[1]=A2-A1=(T14-T13)-(T12-T11) \quad (1)$$

Further, when T13 represents the time when registration sensor 12A detects the straight line portion (i) in the main scanning direction of the registration mark CR for C color on the left side, and when B1 represents an insulated distance (reference value) between the registration mark CR for BK color on the left side in the sub-scanning direction and the registration mark CR for C color on the left side, sub-scanning fine adjustment value [2] is calculated by expression (2), namely, by the following expression.

$$[2]=2240-B1=2240-(T13-T11) \quad (2)$$

In the expression above, a numerical value "2240" is a design value of an insulated distance for each of BK color and C color, and an actual distance varies depending on a way of shifting.

Further, when T14 represents the time when registration sensor 12A detects the inclined portion (ii) of the registration mark CR for C color on the left side, when T21 represents the time when registration sensor 12B shown in FIG. 9 detects the straight line portion (i) in the main scanning direction of the registration mark CR for C color on the right side, when T22 represents the time when the same sensor 12B detects the inclined portion (ii) of the same registration mark CR, when T23 represents the time when the same sensor 12B detects the straight line portion (i) of the registration mark CR for C color on the right side, when T24 represents the time when the same sensor 12B detects the inclined portion (ii) of the same registration mark CR, when A3 represents a jumping-out distance covering from detection trace line Lo of the registration sensor 12B to one end of the registration mark CR for BK color on the right side, when A4 represents a jumping-out distance covering from detection trace line Lo of the same sensor 12B to one end of the registration mark CR for C color on the right side, when C1 represents an insulated distance (reference value) covering from detection trace line Lo of the registration sensor 12A to detection trace line Lo of the registration sensor 12B and when C2 represents an insulated distance (reference value) covering from detection trace line Lo of the registration sensor 12A to detection trace line Lo of the registration sensor 12B, total lateral magnification adjustment value [3] in the main scanning direction is calculated by expression (3), namely, by the following expression, wherein a design value of an insulated distance between registration marks CR for BK color on the left and right sides, for example, takes 2360 dots.

$$\begin{aligned}[3] &= C2-C1 \quad (3)\\ &= (2360-A3+A1)-(2360-A4+A2)\\ &= (A1-A3)-(A2-A4)\\ &= [(T12-T11)-(T22-T21)]-[(T14-T13)-(T24-T23)]\end{aligned}$$

Further, when D1 represents an amount of positional shift (unknown) between registration mark CR for BK color on the left side in the sub-scanning direction and registration mark CR for BK color on the right side, and when D2 represents an amount of positional shift (unknown) between registration mark CR for C color on the left side in the sub-scanning direction and registration mark CR for C color on the right side, a skew adjustment value [4] is calculated by expression [4], namely, by the following expression.

$$\begin{aligned}[4] &= D2-D1 \quad (4)\\ &= (T13-T23)-(T11-T21)\end{aligned}$$

In the same way, an amount of shift between a position of writing of registration mark CR for BK color and a position of writing of registration mark CR for M or Y color is detected, and each amount of correction is calculated from the amount of shift. After that, image forming positions for C color, M color and Y color other than image forming unit 10K for BK color are adjusted.

In this example, if white spots are present on registration mark CR below a detectable area (detection area) of registration sensor 12, a line width (pulse width) of passing time pulse signal Sp becomes narrower, compared with an occasion wherein no white spot is present). In this case, an image forming system restoration mode is carried out after suspending a color-shift-correcting mode.

Figure 10:
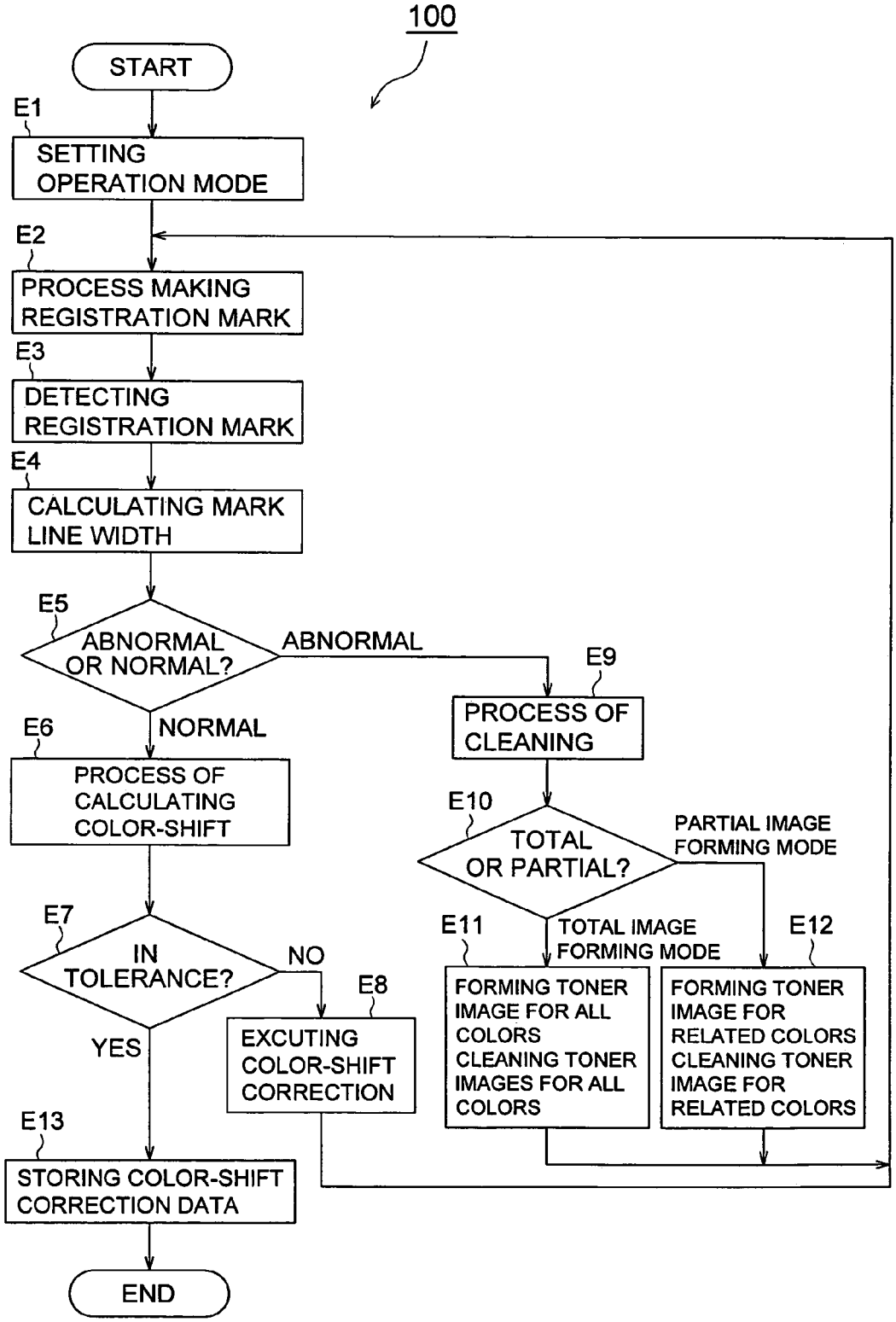
FIG. 10 is a flow chart indicating an example of color-shift correction in color copying machine 100.

Next, an example of color-shift correction for color copying machine 100 will be explained, concerning the image forming method of the invention. FIG. 10 is a flow chart showing an example of color-shift correction on color copying machine 100.

In the present example, a color-shift-correcting mode and an image forming system restoration mode are provided, and registration mark CR for color-shift correction is formed on intermediate transfer belt 6 through each of photoconductor drums 1Y, 1M, 1C and 1K. Then, the registration mark CR formed on the intermediate transfer belt 6 is detected, and a mark line width of the detected registration mark CR is compared with a reference line width prepared in advance, to discriminate abnormality. Depending on the results of the discrimination, the color-shift-correcting mode is continued, or the color-shift-correcting mode is suspended and an image forming system restoration mode is carried out.

An operation mode is established in step E1 of the flow chart shown in FIG. 10. In the course of establishing the operation mode, a color-shift-correcting mode is set. Further, in the case of the image forming system restoration mode, either one of a total image forming mode and a partial image forming mode can be selected. The total image forming mode means operations wherein toner images respectively for all colors for adjustment of an image forming system are formed on the intermediate transfer belt 6 respectively through photoconductor drums 1Y, 1M, 1C and 1K, and then, all toner images respectively for all colors formed on the intermediate transfer belt 6 are removed by cleaning section 8A.

The partial image forming mode is an action in which, in the image forming system restoration mode, the toner image for adjusting the image forming system only for Y color, M color, C color or BK color which is judged as abnormal is formed on intermediate transfer belt 6 through photoconductor drum 1Y, 1M, 1C or 1K, and the toner image of relevant color (Y color, M color, C color or BK color) on intermediate transfer belt 6 is erased. These operation modes are established by using operation means 16.

Afterward, a flow advances Step E2, image forming unit 10Y, 10M, 10C and 10K form a registration mark CR on intermediate transfer belt 6 respectively. At this stage, in image processing circuit 71 shown by FIG. 2, an image data Dy' for color-shift correction is read out from an unillustrated memory and is outputted to Y-signal switching section 72Y, based on image processing control signal S4. Y-signal switching section 72Y selects the image data Dy' according to writing select signal S5, and outputs this image data Dy' to laser writing unit 3Y. Laser writing unit 3Y detects an irradiating timing of the laser beam for Y color and outputs a Y-INDEX signal to CPU 57 in control section 15.

CPU 57 generates a VTOP signal based on the Y-INDEX signal and outputs this VTOP signal to image forming unit 10Y. In image forming unit 10Y, based on the VTOP signal outputted from CPU 57 and a writing data Wy=image data Dy' for Y color outputted from image processing means 70, an electrostatic latent image for color-shift correction is formed on photoconductor drum 1Y. For instance, laser writing unit 3Y scans photoconductor drum 1Y, which is charged beforehand, with a laser beam light for Y color having a predetermined intensity based on the image data Dy'. This laser beam light carries out deflective scanning through a polygon mirror for Y color that rotates at a predetermined speed. On the other hand, photoconductor drum 1Y rotates in a sub-scanning direction.

An electrostatic latent image for color-shift correction is formed on photoconductor drum 1Y when this photoconductor drum 1Y rotates in the sub-scanning direction and when deflective scanning is carried out by the laser beam light in the main scanning direction. The electrostatic latent image formed on photoconductor drum 1Y for color-shift correction is developed by developing unit 4Y. A toner image for color-shift correction of Y color developed by developing unit 4Y is transferred onto intermediate transfer belt 6 through operations of rotating primary transfer roller 7Y (primary transfer).

In the same manner, based on image processing control signal S4, image processing circuit 71 reads image data Dm' for color-shift correction and outputs it to M-signal switching unit 72M. M-signal switching section 72M selects the image data Dm' according to writing select signal S5 and outputs this image data Dm' to laser writing unit 3M. Laser writing unit 3M detects an irradiating timing of the laser beam for M color and outputs a M-INDEX signal to CPU 57.

CPU 57 controls an output of image forming unit 10M based on the M-INDEX signal and the VTOP signal. In image forming unit 10M an electrostatic latent image for color-shift correction is formed on photoconductor drum 1M based on the VTOP signal and a writing data Wm=image data Dm' for M color. For instance, laser writing unit 3M scans photoconductor drum 1M which is charged beforehand with a laser beam light for M color having a predetermined intensity based on the image data Dm'. This laser beam light carries out deflective scanning through a polygon mirror for M color that rotates at a predetermined speed. On the other hand, photoconductor drum 1M rotates in a sub-scanning direction.

An electrostatic latent image for color-shift correction is formed on photoconductor drum 1M when this photoconductor drum 1M rotates in the sub-scanning direction and when deflective scanning is carried out by the laser beam light in the main scanning direction. The electrostatic latent image formed on photoconductor drum 1M for color-shift correction is developed by developing unit 4M. A toner image for color-shift correction of M color developed by developing unit 4M is transferred onto intermediate transfer belt 6 through operations of rotating primary transfer roller 7M (primary transfer).

Further, based on image processing control signal S4, image processing circuit 71 reads image data Dc' for color-shift correction and outputs it to C-signal switching unit 72C. C-signal switching section 72C selects the image data Dc' according to writing select signal S5 and outputs this image data Dc' to laser writing unit 3C. Laser writing unit 3C detects an irradiating timing of the laser beam for C color and outputs C-INDEX signal to CPU 57.

CPU 57 controls an output of image forming unit 10C based on the C-INDEX signal and the VTOP signal. In image forming unit 10C, an electrostatic latent image for color-shift correction is formed on photoconductor drum 1C based on the VTOP signal and a writing data Wc=image data Dc' for C color. For instance, laser writing unit 3C scans photoconductor drum 1C, which is charged beforehand, with a laser beam light for C color having a predetermined intensity based on the image data Dc'. This laser beam light carries out deflective scanning through a polygon mirror for C color that rotates at a predetermined speed. On the other hand, photoconductor drum 1C rotates in a sub-scanning direction.

An electrostatic latent image for color-shift correction is formed on photoconductor drum 1C when this photoconductor drum 1C rotates in the sub-scanning direction and when deflective scanning is carried out by the laser beam light in the main scanning direction. The electrostatic latent image formed on photoconductor drum 1C for color-shift correction is developed by developing unit 4C. A toner image for color-shift correction of C color developed by developing unit 4C is transferred onto intermediate transfer belt 6 through operations of rotating primary transfer roller 7C (primary transfer).

Further more, based on image processing control signal S4, image processing circuit 71 reads image data Dk' for color-shift correction and outputs it to K-signal switching unit 72K. K-signal switching section 72K selects the image data Dk' according to writing select signal S5 and outputs this image data Dk' to laser writing unit 3K. Laser writing unit 3K detects an irradiating timing of the laser beam for BK color and outputs K-INDEX signal to CPU 57.

CPU 57 controls an output of image forming unit 10K based on the K-INDEX signal and the VTOP signal. In image forming unit 10K, an electrostatic latent image for color-shift correction is formed on photoconductor drum 1K based on the VTOP signal and a writing data Wk=image data Dk' for BK color. For instance, laser writing unit 3K scans photoconductor drum 1K, which is charged beforehand, with a laser beam light for K color having a predetermined intensity based on the image data Dk'. This laser beam light carries out deflective scanning through a polygon mirror for KB color that rotates at a predetermined speed. On the other hand, photoconductor drum 1K rotates in a sub-scanning direction.

An electrostatic latent image for color-shift correction is formed on photoconductor drum 1K when this photoconductor drum 1K rotates in the sub-scanning direction and when deflective scanning is carried out by the laser beam light in the main scanning direction. The electrostatic latent image formed on photoconductor drum 1K for color-shift correction is developed by developing unit 4K. A toner image for color-shift correction of K color developed by developing unit 4K is transferred onto intermediate transfer belt 6 through operations of rotating primary transfer roller 7K (primary transfer).

After that, in Step E3, registration sensor 12A and 12B detect the registration mark CR for each of Y, M and C colors corresponding to the reference color (BK color). At this stage, registration sensor 12A causes an unillustrated light-emitting element to throw light on intermediate transfer belt 6 traveling in sub-scanning direction at a constant linear speed, and detects the reflected light coming from the registration mark CR with a light-receiving element. Registration sensor 12A detects the edges of straight line (i) and registration mark CR of inclined portion on intermediate transfer belt 6, and outputs image detection signal S2. Image detection signal 2 is binarized by A/D converter 13 into image detecting data Dp. Image detecting data Dp is stored in nonvolatile memory 14. Image detecting data Dp is used to calculate an amount of deviation of each of writing positions of Y, M and C colors from the writing position of registration mark CR for BK color.

Meanwhile, the VTOP signal rises at a timing t0 to start an unillustrated counter, then the number of pluses of standard clock signal is counted, and when front edge detecting timing ta comes, information of elapsed time D (T1) is outputted from the counter. In the same way, the counter further counts the number pluses of standard clock signal, and when rear edge detecting time tb comes, information of elapsed time D(T2) is outputted from the counter. Further, the counter counts the number of pluses of the standard clock signal, and when the front edge detecting timing tc comes, for registration mark of inclined portion (ii, information of elapsed time D(T3) is outputted from the counter, then, when the rear edge detecting timing td comes, information of elapsed time D(T4) is outputted. These items of information of elapsed time D(T1), D(T2), D(T3) and D(T4) are stored in nonvolatile memory 14.

Then, in step E4, CPU 57 calculates the mark line width of registration mark CR of each Y, M, C and BK colors. For instance, a width of mark line in the sub-scanning direction of registration mark of the straight portion (i) for Y color in FIG. 7A, is obtained by reading information of elapsed time D (T1) and D (T2) from nonvolatile memory 14, and by calculating (T2−T1) based on information of elapsed time D (T1) and D (T2) with CPU 57. The mark line width can be obtained from information of elapsed time D(T1) and D(T2) because intermediate transfer belt 6 is traveling in sub-scanning direction at a constant linear speed. Also, the mark line width of registration mark of inclined portion (ii) in a sub-scanning direction is obtained in the same way in which CPU 57 reads out information of elapsed time D(T3) and D(T4) from nonvolatile memory 14, and calculates $\sqrt{(2\cdot(T3-T4)/2)}$ based on information of elapsed time D(T3) and D(T4). For the registration marks CR of the other colors, the same calculation is done. The data obtained by these calculations are to be mark line width data Dx. The mark line width data Dx are stored in nonvolatile memory 14.

After that, in step E5, CPU 57 discriminates if the mark line width of registration mark CR for each Y, M, C and BK color is normal or abnormal. On this occasion, CPU 57 reads out mark line width data Dx and reference line width data Dr (designed line width of registration mark CR) from nonvolatile memory 14 and compare. With this result of comparison, if the mark line width is judged to be within the tolerance of the reference line width, the mark line width is judged to be normal. Contrarily, in case the mark line width is out of the tolerance, in other words, in case the mark line width data Dx having not less than a specified amount of difference exists, the mark line width is judged to be abnormal. Abnormality of mark line width is judged respectively for each color. For instance, it is judged by saying that "the mark line width of registration mark CR of Y color is abnormal".

In case the mark line width of registration mark CR for each Y, M, C and BK color is judged to be normal with the result of the above judgment, a flow advances to step E5, where the amount of color-shift among these marks is calculated to continue the color-shift correcting mode (see FIG. 9).

In an example shown in FIG. 9, regarding the amount of color-shift correction, because the writing position of each registration mark CR for Y, M and C color is adjusted to match the writing position of registration mark CR of BK color, the amount of color-shift for each color is calculated based on registration mark CR of BK color. For example, regarding writing position adjustment of C color, the writing position of the registration mark CR of BK color and the writing position of the registration mark CR of C color are detected and the deviation of writing position of C color from BK color is calculated to obtain the amount of correction. As the amounts of correction, a main scanning rough adjustment value (1) is calculated by formula (1), sub-scanning fine adjustment value (2) is calculated by formula (2), a total lateral magnification adjusting value (3) in main scanning direction is calculated by formula (3) and a skew adjustment value (4) is calculated by formula (4). In the same manner, for the writing position adjustment of M and Y color, by detecting the deviation amounts of the writing position of registration mark CR of M and Y color from the writing position of registration mark CR of BK color respectively, each of the color-shift correcting data Dϵ is calculated by these deviation amounts. Color-shift correcting data Dϵ is stored in nonvolatile memory 14.

Then, in step E6, CPU 57 judges if the amount of color-shift is within the tolerance or not. On this occasion, CPU 57 reads out color-shift correcting data Dϵ and a threshold amount of color-shift Dth (designed tolerance of amount of color-shift) from nonvolatile memory 14 and compare them. If the mount of color-shift is judged to be within the tolerance, a flow moves to step 12E where the color-shift correcting data Dϵ is stored and color-shift correcting mode is terminated. In step A7, if the amount of shear of color printing is judged to be out of the tolerance, since color-shift correction is needed to be reprocessed, a flow moves to step E8 where after executing the color-shift correction again and a flow returns to step E2, and above mentioned process of color-shift correction is repeated.

Also, in step E5, if the mark line width is judged to be "abnormal", a flow advances step E9 where image forming system restoration mode is carried out. In step E9, the toner image of each Y, M, C and BK color on intermediate transfer belt 6 formed in aforesaid color-shift correcting mode is erased by cleaning section 8A. Also, the toner image of Y color remaining on photoconductor drum 1Y is erased by cleaning section 8Y, the toner image of M color remaining on photoconductor drum 1M is erased by cleaning section 8M, the toner image of C color remaining on photoconductor drum 1C is erased by cleaning section 8C and the toner image of BK color remaining on photoconductor drum 1K is erased by cleaning section 8K respectively.

After that, a flow advances step E10 where CPU 57 diverges the operations based on an operation mode set in advance. In case a total image forming mode is set in step E10, a flow advances E11, where the total image forming mode is carried out. In the total image forming mode, through photoconductor drum 1Y, 1M, 1C and 1K, all the toner images of Y, M, C and BK colors for adjusting the image forming system are formed on intermediate transfer belt 6.

For instance, in image processing circuit 71 shown in FIG. 2, based on image processing control signal S4, image data Dy" for image forming system adjusting is read out from an unillustrated memory and outputted to Y-signal switching section 72Y. Y-signal switching section 72Y selects image data Dy" according to writing select signal S5 and outputs this image data Dy" to laser writing unit 3Y. Laser writing unit 3Y detects an irradiating timing of the laser beam for Y color and outputs a Y-INDEX signal to CPU 57 in control device 15.

CPU 57 generates a VTOP signal based on the Y-INDEX signal and outputs this VTOP signal to image forming unit 10Y. In image forming unit 10Y, based on the VTOP signal outputted from CPU 57 and a writing data Wy=image data Dy" for Y color outputted from image processing means 70, an electrostatic latent image for adjusting the image forming system is formed on photoconductor drum 1Y. For instance, laser writing unit 3Y scans with a laser beam light for Y color having a predetermined intensity based on the image data Dy" photoconductor drum 1Y, which is charged beforehand. This laser beam light carries out deflective scanning through a polygon mirror for Y color that rotates at a predetermined speed. On the other hand, photoconductor drum 1Y rotates in a sub-scanning direction.

An electrostatic latent image for adjusting the image forming system is formed on photoconductor drum 1Y when this photoconductor drum 1Y rotates in the sub-scanning direction and when deflective scanning is carried out by the laser beam light in the main scanning direction. The electrostatic latent image formed on photoconductor drum 1Y for adjusting the image forming system is developed by developing unit 4Y. A toner image for adjusting the image forming system of Y color developed by developing unit 4Y is transferred onto intermediate transfer belt 6 through operations of rotating primary transfer roller 7Y (primary transfer).

In the same manner, based on image processing control signal S4, image processing circuit 71 reads image data Dm" for adjusting the image forming system and outputs it to M-signal switching unit 72M. M-signal switching section 72M selects the image data Dm" according to writing select signal S5 and outputs this image data Dm" to laser writing unit 3M. Laser writing unit 3M detects an irradiating timing of the laser beam for M color and outputs a M-INDEX signal to CPU 57.

CPU 57 controls an output of image forming unit 10M based on the M-INDEX signal and the VTOP signal. In image forming unit 10M, an electrostatic latent image for adjusting the image forming system is formed on photoconductor drum 1M based on the VTOP signal and a writing data Wm=image data Dm" for M color. For instance, laser writing unit 3M scans photoconductor drum 1M, which is charged beforehand, with a laser beam light for M color having a predetermined intensity based on the image data Dm". This laser beam light carries out deflective scanning through a polygon mirror for M color that rotates at a predetermined speed. On the other hand, photoconductor drum 1M rotates in a sub-scanning direction.

An electrostatic latent image for adjusting the image forming system is formed on photoconductor drum 1M when this photoconductor drum 1M rotates in the sub-scanning direction and when deflective scanning is carried out by the laser beam light in the main scanning direction. The electrostatic latent image formed on photoconductor drum 1M for adjusting the image forming system is developed by developing unit 4M. A toner image for adjusting the image forming system of M color developed by developing unit 4M is transferred onto intermediate transfer belt 6 through operations of rotating primary transfer roller 7M (primary transfer).

Further, based on image processing control signal S4, image processing circuit 71 reads image data Dc" for adjusting the image forming system and outputs it to C-signal switching unit 72C. C-signal switching section 72C selects the image data Dc" according to writing select signal S5 and outputs this image data Dc" to laser writing unit 3C. Laser writing unit 3C detects an irradiating timing of the laser beam for C color and outputs C-INDEX signal to CPU 57.

CPU 57 controls an output of image forming unit 10C based on the C-INDEX signal and the VTOP signal. In image forming unit 10C, an electrostatic latent image for adjusting the image forming system is formed on photoconductor drum 1C based on the VTOP signal and a writing data Wc=image data Dc" for C color. For instance, laser writing unit 3C scans photoconductor drum 1C, which is charged beforehand, with a laser beam light for C color having a predetermined intensity based on the image data Dc". This laser beam light carries out deflective scanning through a polygon mirror for C color that rotates at a predetermined speed. On the other hand, photoconductor drum 1C rotates in a sub-scanning direction.

An electrostatic latent image for adjusting the image forming system is formed on photoconductor drum 1C when this photoconductor drum 1C rotates in the sub-scanning direction and when deflective scanning is carried out by the laser beam light in the main scanning direction. The electrostatic latent image formed on photoconductor drum 1C for adjusting the image forming system is developed by developing unit 4C. A toner image for color-shift correction of C color developed by developing unit 4C is transferred onto intermediate transfer belt 6 through operations of rotating primary transfer roller 7C (primary transfer).

Further more, based on image processing control signal S4, image processing circuit 71 reads image data Dk" for adjusting the image forming system and outputs it to K-signal switching unit 72K. K-signal switching section 72K selects the image data Dk" according to writing select signal S5 and outputs this image data Dk" to laser writing unit 3K. Laser writing unit 3K detects an irradiating timing of the laser beam for BK color and outputs K-INDEX signal to CPU 57.

CPU 57 controls an output of image forming unit 10K based on the K-INDEX signal and the VTOP signal. In image forming unit 10K, an electrostatic latent image for adjusting the image forming system is formed on photoconductor drum 1K based on the VTOP signal and a writing data Wk=image data Dk" for BK color. For instance, laser writing unit 3K scans photoconductor drum 1K, which is charged beforehand, with a laser beam light for K color having a predetermined intensity based on the image data Dk". This laser beam light carries out deflective scanning through a polygon mirror for KB color that rotates at a predetermined speed. On the other hand, photoconductor drum 1K rotates in a sub-scanning direction.

An electrostatic latent image for adjusting the image forming system is formed on photoconductor drum 1K when this photoconductor drum 1K rotates in the sub-scanning direction and when deflective scanning is carried out by the laser beam light in the main scanning direction. The electrostatic latent image-formed on photoconductor drum 1K for adjusting the image forming system is developed by developing unit 4K. A toner image for adjusting the image forming system of K color developed by developing unit 4K is transferred onto intermediate transfer belt 6 through operations of rotating primary transfer roller 7K (primary transfer).

After that, all the toner images of Y, M, C and BK color formed on aforesaid intermediate transfer belt 6 is erased by cleaning section 8A. Naturally, the toner image for Y color remaining on photoconductor drum 1Y is erased by cleaning section 8Y, the toner image for M color remaining on photoconductor drum 1M is erased by cleaning section 8M, the toner image for C color remaining on photoconductor drum 1C is erased by cleaning section 8C and the toner image for BK color remaining on photoconductor drum 1K is erased by cleaning section 8K respectively. Thereby the cause of white spot is eliminated and all the image forming systems for YMCK are restored to normal operation.

Also, in case partial image forming mode is set in step E10, a flow advances step E12, where the partial image forming mode is carried out. In the partial image forming mode, for instance, if mark line width of registration mark CR for Y color is judged to be abnormal, only Y color toner image for adjusting the image forming system is formed on intermediate transfer belt 6 through photoconductor drum 1Y.

For instance, in image processing circuit 71 shown by FIG. 2, an image data Dy" for adjusting the image forming system is read out from an unillustrated memory and is outputted to Y-signal switching section 72Y based on image processing control signal S4. Y-signal switching section 72Y outputs the image data Dy" to laser writing unit 3Y according to writing select signal S5. Laser writing unit 3Y detects an irradiating timing of the laser beam for Y color and outputs a Y-INDEX signal to CPU 57 in control section 15.

CPU 57 outputs VTOP signal which is generated based on Y-INDEX signal to image forming unit 10Y. In image forming unit 10Y, based on VTOP signal outputted from CPU 57 and writing data Wy=image data Dy" for Y color outputted from Y-signal switching section 72, an electrostatic latent image for Y color toner is formed on photoconductor drum 1Y. The electrostatic latent image for Y color toner formed on photoconductor drum 1Y is developed by developing unit 4Y. The Y color toner image developed by developing unit 4Y is transferred to intermediate transfer belt 6 through operations of rotating primary transfer roller 7Y (primary transfer).

After that, the Y color toner image formed on aforesaid intermediate transfer belt 6 is erased by cleaning section 8A. Naturally, the Y color toner image formed on photoconductor drum 1Y may be erased by cleaning section 8Y without carrying out primary transfer. Thereby, the factor causing white spot and so forth in the image forming system for Y color is eliminated, and the image forming system for Y color can be restored to the normal condition. Even in case the mark line width of registration mark CR for each of the other colors is judged to be abnormal, the same operation is carried out to restore the image forming system for the other colors. After that, a flow returns to step E2, where color-shift correcting mode is restarted.

In the total image forming mode or the partial image forming mode in step E11 or E12 respectively, an image of A3 size full-page solid, for example, is used as an image data for adjusting the image forming systems of the related colors. Also, as another example of an image data a plurality of A3 size striped images, which make a full-page solid image being superposed together, can be used for instance, and the striped images which correspond to 8 pages of full-page solid images can be formed. The purpose of using the striped images is not to over load the cleaning section. Forming a plurality of images like abovementioned also has an effect of ejecting cohered toner in the developing units.

Meanwhile, in case the amount of color-shift is judged to be within the tolerance in step E7, a flow moves to step E12, where color-shift correction data Dϵ is stored in nonvolatile memory 14 or so forth and process of color-shift correction is terminated. In ordinary image forming mode, based on color-shift correcting data Dϵ, the start timing of writing of image data Dy, Dm and Dc is corrected. Thereby, the image forming position for C, M and Y color other than image forming unit 10K for BK color, which is the reference can be adjusted.

Thus, according to a color copying machine and its image forming method as an example of present invention, in case a color image is formed on intermediate transfer belt 6 through photoconductor drums 1Y, 1M, 1C and 1K, and color-shift correction carried out, CPU 57 compares a mark line width detected by registration sensor 12 with a reference line width prepared beforehand to discriminate the abnormality, then according to the result of aforesaid judgment, continues the color-shift correcting mode or discontinues the color-shift correcting mode to carry out the image forming system restoration mode.

Therefore, in the course of the color-shift correcting mode, if it is judged to be "abnormal", the color-shift correcting mode is discontinued and toner images for all colors or related colors for adjusting the image forming system are formed on intermediate transfer belt 6 through photoconductor drums 1Y, 1M, 1C and 1K. After that, by erasing the toner images for all colors or related colors for adjusting the image forming system, image forming unit 10Y, 10M, 10C and 10K can be restored to normal condition. Thereby, even in case white spot occurs by some reason, the color-shift correction mode can be carried out on image forming unit 10Y, 10M, 10C and 10C in normal condition, since the color-shift correcting mode is restarted after image forming system restoration mode is carried out.

POSSIBILITY OF USE IN INDUSTRY

This invention is suitably applied to a color printer and a color copying machine both of a tandem type and to a color multifunctional machine each having a photoconductor drum, intermediate transfer belt and color-shift correcting mode.

What is claimed is:

1. An image forming apparatus comprising:

an image carrier to hold a color toner image thereon;

an image forming section to form the color toner image on the image carrier;

a control section which detects an amount of positional shift between a registration mark of a reference color and a registration mark of another color, both registration marks being formed on the image carrier by the image forming section for a color-shift-correction;

a cleaning section to remove the color toner image formed on the image carrier; and an image detecting section which senses the registration mark on the image carrier and outputs an image detection signal representing the line width of the registration mark;

wherein during the execution of a color-shift-correcting mode, where the image forming section forms the registration mark on the image carrier, the control section detects the amount of the position shift of the registration mark and the control section corrects a position of an image according to the amount of the positional shift, the control section calculates the line width of the registration mark from the image detection signal and then compares the line width of the registration mark with a reference value of line width to discriminate between normality and abnormality; then if normality, the control section continues the execution of the color-shift-correcting mode and if abnormality, the control section stops the execution of the color-shift-correcting mode and execute an image forming system restoration mode, where the image forming section forms the color toner image on the image carrier for restoring an image forming system as a restoration image and then the cleaning section removes the restoration image for cleaning the image forming system.

2. The image forming apparatus of claim 1, wherein during the execution of the color-shift correcting mode, the control section compares the detected line width of the registration mark with a reference value of line width and if the difference between the detected line width of the registration mark and the reference value of line width is no more than a predetermined value, the control section continues the execution of the color-shift-correcting mode and if the difference is more than the predetermined value, the control section execute the color-shift-correcting mode after stopping the execution of the color-shift-correcting mode and next executing the image forming system restoration mode.

3. The image forming apparatus of claim 1, wherein the control section calculates the amount of the position shift between the registration mark of the reference color and the registration mark of another color by reading the passing timing of the registration mark formed on the image carrier.

4. The image forming apparatus of claim 1, wherein when the control section detects the line width of the registration mark on the image carrier, the control section detects the time of detecting the front edge of the registration mark and the time of detecting the rear edge of the registration mark with a reference of a start signal which allows start of writing the color toner image on the image carrier and calculates the information of the line width according to the time of detecting the front edge of the registration mark and the time of detecting the rear edge of the registration mark.

5. The image forming apparatus of claim 1, wherein during executing the image forming system restoration mode, the control section controls the image forming section so that the image forming section forms restoration images of all the colors for the image forming system restoration on the image carriers and controls the cleaning section so that the cleaning section removes all the restoration images formed on the image carriers.

6. The image forming apparatus of claim 1, wherein during executing the image forming system restoration mode, the control section controls the image forming section so that the image forming section only forms the restoration image of the color whose line width is with abnormality and controls the cleaning section so that the cleaning section removes the restoration images formed on the image carrier.

7. The image forming apparatus of claim 1, comprising: a photoreceptor, a plurality of developing devices, and an intermediate transferring member which holds the color toner image transferred from the photoreceptor, wherein the image carrier is the intermediate transferring member.

8. A method of forming an image comprising:

forming a color image on an image carrier to hold a color image, executing a color-shift-correcting mode where a registration mark with a predetermined line width is formed on the image carrier for a color-shift-correction, an amount of positional shift between a registration mark of the reference color and the registration mark of another color is detected and a position of an image is corrected according to the amount of the positional shift;

detecting the line width of the registration mark on the image carrier during executing the color-shift-correcting mode;

comparing the detected line width of the registration mark with a reference value of line width to discriminate between normality and abnormality;

continuing the execution of the color-shift-correcting mode if normality; and executing an image forming system restoration mode, where a restoration image is formed on the image carrier for restoring an image forming system and then the restoration image is removed for cleaning the image forming system, after stopping the execution of the color-shift correcting mode if abnormality.

9. The method of claim 8, further comprising:

comparing the detected line width of the registration mark with the reference value of line with;

continuing the execution of the color-shift-correcting mode if the difference between the detected line width of the registration mark and the reference value of line width is no more than a predetermined value; and executing the image forming system restoration mode after stopping the execution of the color-shift-correcting mode if the difference is more than the predetermined value.

10. The method of claim 8, further comprising: calculating the amount of the position shift between the registration mark of the reference color and the registration mark of another color by reading the passing timing of the registration mark formed on the image carrier.

11. The method of claim 8, wherein when detecting the line width of the registration mark on the image carrier, the time of detecting the front edge of the registration mark and the time of detecting the rear edge of the registration mark are detected with a reference of a start signal which allows start of writing the print image on the image carrier and the information of the line width is calculated according to the time of detecting the front edge of the registration mark and the time of detecting the rear edge of the registration mark.

12. The method of claim 8, further comprising:

forming restoration images of all the colors on the image carrier; and removing all the restoration images formed on the image carrier.

13. The method of claim 8, further comprising:

forming restoration images only of the color whose line width is with abnormality on the image carrier; and removing the restoration images formed on the image carrier.

14. The method of claim 8 for use in an image forming apparatus comprising a photoreceptor, a plurality of developing devices, and an intermediate transferring member which holds the color toner image transferred from the photoreceptor, wherein the image carrier is the intermediate transferring member.

15. An image forming apparatus comprising:

an image carrier to hold a color toner image thereon;

means for forming the color toner image on the image carrier;

a control section which detects an amount of positional shift between a registration mark of a reference color and a registration mark of another color, both registration marks being formed on the image carrier by the image forming means for a color-shift-correction;

means for cleaning the color toner image formed on the image carrier; and means for sensing the registration mark on the image carrier and outputs an image detection signal representing the line width of the registration mark;

wherein during the execution of a color-shift-correcting mode, where the image forming means forms the registration mark on the image carrier, the control section detects the amount of the position shift of the registration mark and the control section corrects a position of an image according to the amount of the positional shift, the control section calculates the line width of the registration mark from the image detection signal and then compares the line width of the registration mark with a reference value of line width to discriminate between normality and abnormality, then if normality, the control section continues the execution of the color-shift-correcting mode and if abnormality, the control section stops the execution of the color-shift-correcting mode and execute an image forming system restoration mode, where the image forming means forms the color toner image on the image carrier for restoring an image forming system as a restoration image and then the cleaning means removes the restoration image for cleaning the image forming system.

* * * * *